US007350667B2

(12) United States Patent
Yuyama

(10) Patent No.: US 7,350,667 B2
(45) Date of Patent: Apr. 1, 2008

(54) INJECTION DRUG FEEDING DEVICE

(75) Inventor: Shoji Yuyama, Toyonaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 102 days.

(21) Appl. No.: 10/969,920

(22) Filed: Oct. 22, 2004

(65) Prior Publication Data

US 2005/0098574 A1 May 12, 2005

Related U.S. Application Data

(63) Continuation of application No. 10/239,748, filed as application No. PCT/JP01/02386 on Mar. 26, 2001, now Pat. No. 6,981,609.

(30) Foreign Application Priority Data

| | | |
|---|---|---|
| Mar. 28, 2000 | (JP) | 2000-088631 |
| Sep. 8, 2000 | (JP) | 2000-274053 |
| Nov. 15, 2000 | (JP) | 2000-348566 |

(51) Int. Cl.
*G07F 11/00* (2006.01)

(52) U.S. Cl. ..... 221/5; 221/123; 221/133

(58) Field of Classification Search ..... 221/5, 221/150 R
See application file for complete search history.

(56) References Cited

U.S. PATENT DOCUMENTS

| | | | | |
|---|---|---|---|---|
| 4,953,745 | A * | 9/1990 | Rowlett, Jr. | 221/5 |
| 5,240,139 | A * | 8/1993 | Chirnomas | 221/2 |
| 5,713,485 | A | 2/1998 | Liff et al. | |
| 5,810,061 | A | 9/1998 | Yuyama | |
| 5,988,858 | A | 11/1999 | Yuyama et al. | |
| 6,041,963 | A | 3/2000 | Yuyama et al. | |
| 6,138,868 | A | 10/2000 | Yuyama et al. | |
| 6,189,728 | B1 | 2/2001 | Yuyama et al. | |
| 6,253,955 | B1 * | 7/2001 | Bower | 221/150 R |
| 6,779,684 | B2 * | 8/2004 | Shin | 221/150 R |

FOREIGN PATENT DOCUMENTS

| | | |
|---|---|---|
| EP | 0 208 029 | 1/1987 |
| JP | 51-6945 | 3/1976 |
| JP | 55-92615 | 6/1980 |
| JP | 61-232139 | 10/1986 |
| JP | 64-75322 | 3/1989 |
| JP | 2-28406 | 1/1990 |
| JP | 3-182406 | 8/1991 |
| JP | 5-229660 | 9/1993 |
| JP | 7-19714 | 1/1995 |
| JP | 8-208039 | 8/1996 |
| JP | 8-244890 | 9/1996 |

(Continued)

*Primary Examiner*—David H Bollinger
(74) *Attorney, Agent, or Firm*—Wenderoth, Lind & Ponack, L.L.P.

(57) ABSTRACT

On each of a plurality of disposed racks, an injection drug storing container is each detachably mounted. The injection drug storing container includes a transportation device for transporting a stored injection drug in one direction. The injection drug transported by the transportation device is housed in each housing portion formed on a circumferential portion of a rotating body one by one. The injection drug in each housing portion is sequentially delivered one by one by rotation of the rotating body.

8 Claims, 31 Drawing Sheets

FOREIGN PATENT DOCUMENTS

| | | |
|---|---|---|
| JP | 8-258964 | 10/1996 |
| JP | 9-51922 | 2/1997 |
| JP | 9-253162 | 9/1997 |
| JP | 2695732 | 9/1997 |
| JP | 9-324981 | 12/1997 |
| JP | 10-35879 | 2/1998 |
| JP | 10-83476 | 3/1998 |
| JP | 10-324309 | 12/1998 |
| JP | 10-324415 | 12/1998 |
| JP | 10-329910 | 12/1998 |
| JP | 11-349127 | 12/1999 |
| JP | 2000-72204 | 3/2000 |

* cited by examiner

Fig. 8A
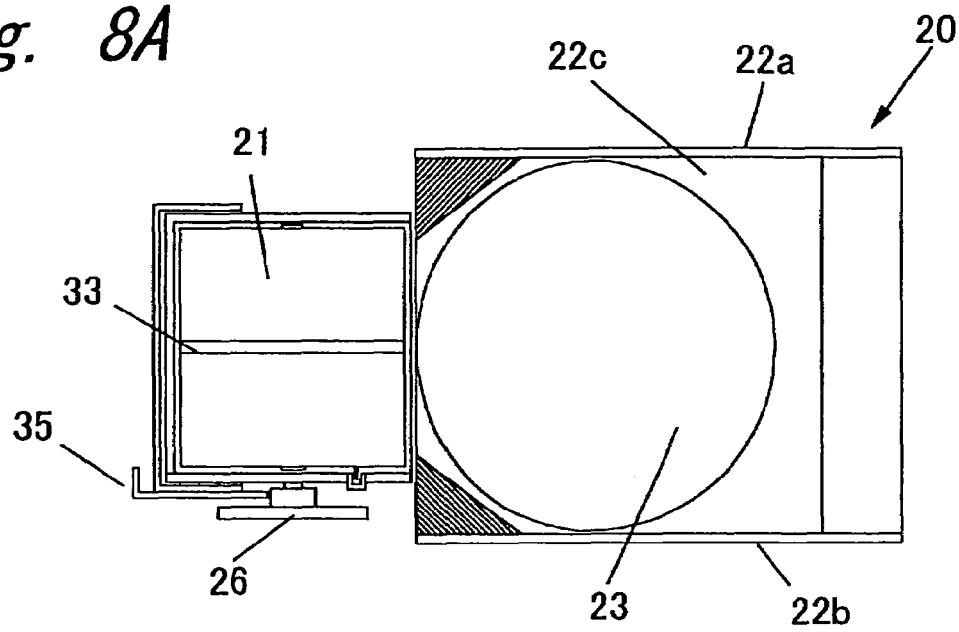
Fig. 8B
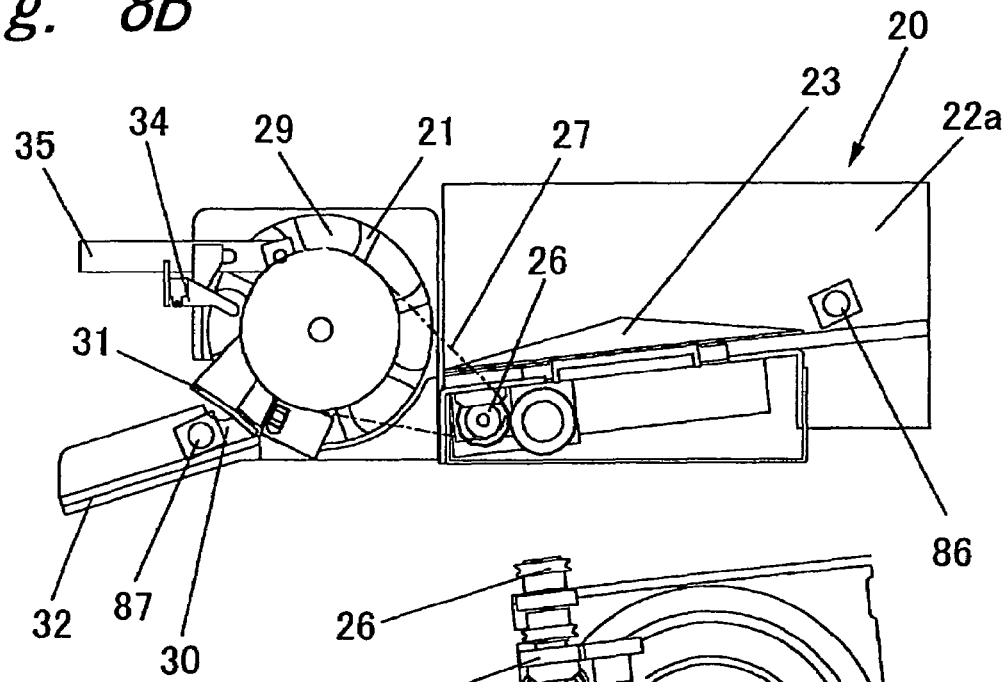
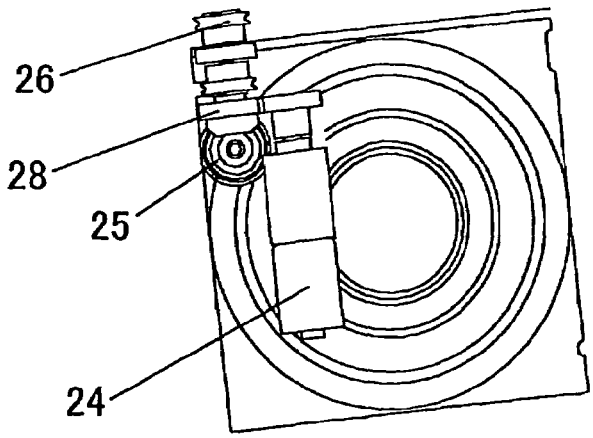
Fig. 8C

Fig. 9A
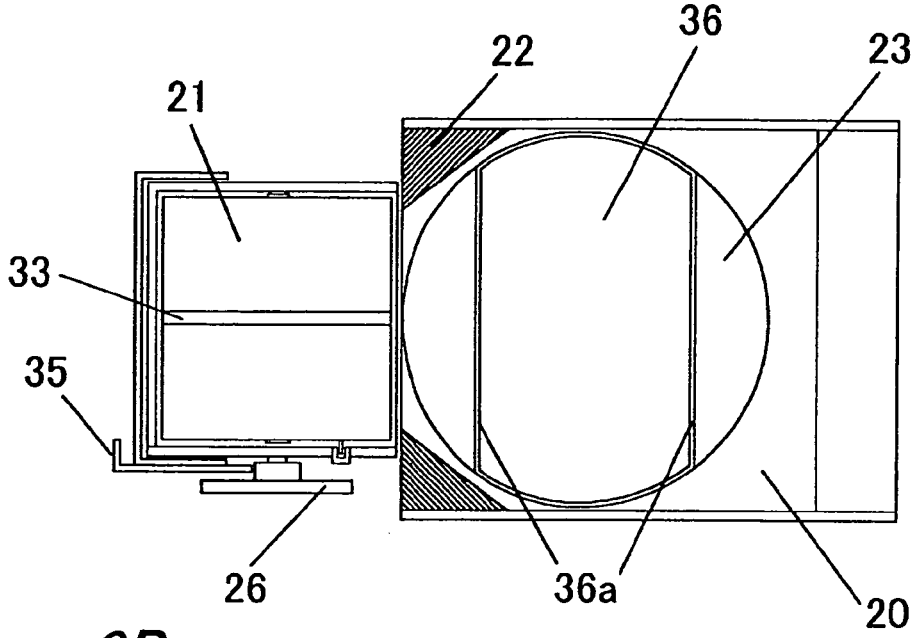
Fig. 9B
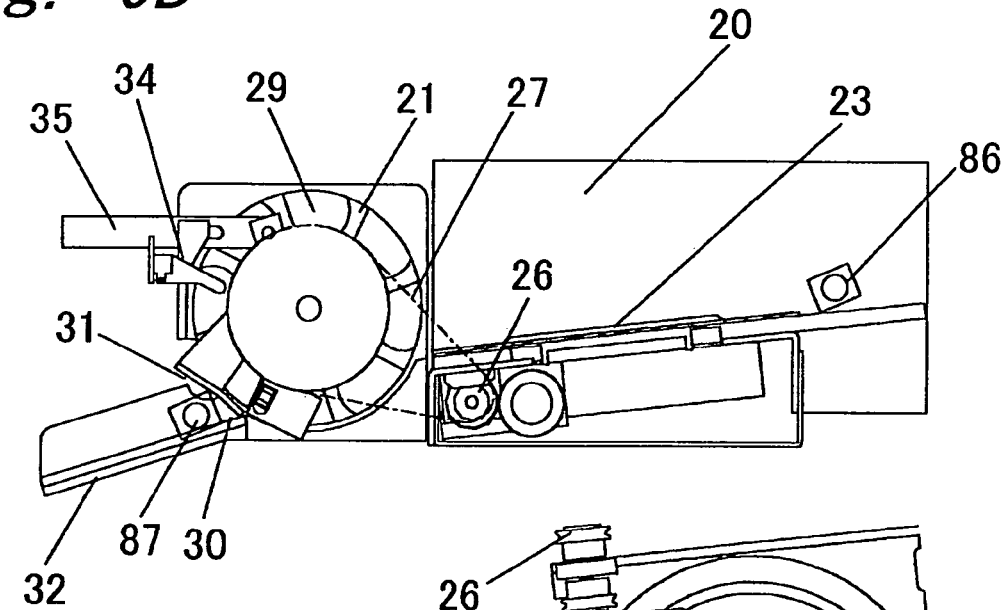
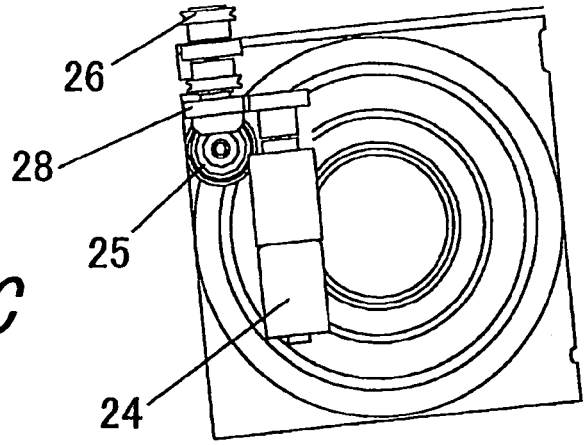
Fig. 9C

INJECTION DRUG FEEDING DEVICE

This is a continuation of Ser. No. 10/239,748, filed Dec. 10, 2002, now U.S. Pat. No. 6,981,609, which is the National Stage of International Application No.PCT/JP01/02386, filed Mar. 26, 2001.

BACKGROUND OF THE INVENTION

1. Technical Field

The present invention relates to an injection drug feeding device for automatically feeding ampoules and vials according to injection drug prescription data.

2. Description of Related Art

Conventionally, as a device for automatically feeding injection drugs such as ampoules and vials, there have been, for example, a first conventional example disclosed in Japanese Patent Laid-Open Publication HEI No. 05-229660 and Japanese Patent Laid-Open Publication HEI No. 08-208039 and a second conventional example disclosed in Japanese Patent Laid-Open Publication HEI No. 08-258964.

In the first conventional example, a plurality of injection drugs are stored in an aligned state in a cassette, and delivered one by one based on injection drug precipitation data and the like.

In the second conventional example, a plurality of injection drugs are stored in a random state in a drug feeder, and delivered one by one based on injection drug precipitation data and the like.

However, in the first conventional example, the injection drugs are compact as they are aligned, although alignment operation is complicated and takes time. In the second conventional example, storing the injection drugs in the drug feeder is easy, although occupation volume of the device is large and therefore the configuration thereof suffers difficulty in increasing a delivery speed.

Particularly since injection drugs are contained in fragile containers such as ampoules, higher processing speed increases a risk of breakage.

In addition, diversified forms of injection drugs require the injection drug feeding device that supports the injection drugs in the special forms.

SUMMARY OF THE INVENTION

Accordingly, in order to solve the above problem, it is an object of the present invention to provide an injection drug feeding device for implementing random storage of injection drugs such as ampoules and vials, and enabling high speed processing without breaking the injection drugs.

In order to accomplish the above object of the present invention, an injection drug feeding device for automatically feeding an appropriate injection drug based on injection drug prescription data comprises a rotating body having a plurality of housing portions capable of housing an injection drug transported from the injection drug storing container mounted on the rack and an auxiliary introduction portion for facilitating introduction of the injection drug into the housing portion and ensuring that only one injection drug is held in the housing portion, the rotating body enabling sequential delivery of the injection drugs housed in each housing portion; and a space container provided between the injection drug storing container and the rotating body for adjusting direction of the injection drug.

According to the above structure, high integration is enabled only by mounting the injection drug storing container, which stores injection drugs at random, on each of a plurality of the racks. In addition, the injection drugs in the injection drug storing container may be certainly and effectively delivered only by driving the transportation means and by rotating the rotating body.

Preferably, between the injection drug storing container and the rotating body, a space container for adjusting direction of the injection drug is provided.

Also, in order to accomplish the above object of the present invention, an injection drug feeding device for automatically feeding an appropriate injection drug based on injection drug prescription data comprises a plurality of racks;

an injection drug storing container provided on each of the racks for storing injection drugs of a same kind and having transportation means for transporting stored injection drugs;

a rotating body having a plurality of housing portions capable of housing an injection drug transported from the injection drug storing container mounted on the rack and an auxiliary introduction portion for facilitating introduction of the injection drug into the housing portion and ensuring that only one injection drug is held in the housing portion, the rotating body enabling sequential delivery of the injection drugs housed in each housing portion; and a space container for adjusting direction of the injection drug is provided between the injection drug storing container and the rotating body.

It may be structured such that an injection drug from the injection drug storing container is received when the housing portion of the rotating body is rotated so that an outer peripheral aperture portion is positioned on a lower side, and an injection drug is deliverable when the housing portion of the rotating body is rotated so that an inner peripheral aperture portion is positioned on an upper side.

A shutter may be provided on an outlet of the rotating body, and the injection drugs may be picked out one by one from each housing portion by opening and closing the shutter.

Preferably, detection means for detecting a passing injection drug is provided on the space container for enabling stock management.

Mounting the injection drug storing container detachably on each rack is suitable for replenishment of the injection drugs and the like.

The transportation means provided on the injection drug storing container may be composed of a belt conveyer.

Preferably, the injection drug storing container is provided with a door openable around a spindle, and a guide protrusion is formed on both sides of the door, while on the rack there is formed a curved pilot guide groove on which the guide protrusion slides and which rotates the door based on positional relation with the spindle, by which the door is closed based on positional relation between the spindle and the guide protrusion that slides on the pilot guide groove when the injection drug storing container is mounted on the rack, which implements automatic opening and closing of the door only by mounting and demounting the injection drug storing container.

Preferably, the position of a curved portion is displaced between each pilot guide portion of the rack, which secures opening and closing operation of the door.

Also in order to accomplish the above object of the present invention, an injection drug feeding device for automatically feeding an appropriate injection drug based on injection drug prescription data comprises a plurality of racks, an injection drug storing container provided detachably on each of the racks for storing injection drugs of a same kind, and a collection lifter capable of moving to a rack that accommodates an injection drug storing container storing an appropriate injection drug based on the injection drug prescription data, and collecting a specified number of delivered injection drugs.

Under the collection lifter there may be provided transportation means for transporting an injection drug transferred from the collection lifter, and a pressure shutter for temporarily storing the injection drug transported by the transportation means and for preventing the injection drug from remaining in the transportation means by circulating at a time of transportation.

Preferably, a bottom face of the collection lifter is composed of a bottom plate provided in an openable manner around a spindle, and a falling height absorber plate rotatable about a hinge provided on a free edge of the bottom plate, which enables smooth discharge of the injection drug from the collection lifter without exerting impact to the injection drug.

The falling height absorber plate may be made from an elastic material.

A transfer unit may be provided for collecting an injection drug transported from the collection lifter via the transportation means, and a bottom face made of a frame body enabling rising and falling of the transfer unit may be composed of an openable bottom sheet and a guide container.

The bottom sheet may be made from an elastic material.

Also, in order to accomplish the above object of the present invention, an injection drug feeding device for automatically feeding an appropriate injection drug based on injection drug prescription data comprises a casing having cold reserving space divided by a heat insulator, and a support casing provided inside the casing for supporting transportation means that transports each injection drug housed by kind.

The casing is provided with a door that has an heat insulated structure, enables opening and closing, and has an identification window for enabling identification of an injection drug, and with indication means for indicating presence of the injection drug, and a confirmation window is formed on the door for enabling confirmation of an operating state by the transportation means, which enables confirmation of operation by visual observation.

Also, in order to accomplish the above object of the present invention, an injection drug feeding device for automatically feeding an appropriate injection drug based on injection drug prescription data comprises an injection drug storing container having transfer means for transferring the plastic injection drugs along attachment direction; and cutting means for cutting off one plastic injection drug from the plastic injection drugs transferred from the injection drug storing container to a specified position by the transfer means; and a shutter for temporarily storing a plastic injection drug cut off by the cutting means.

Preferably, the cutting means is composed of a cutter for cutting an attachment portion of the plastic injection drugs provided between positioning means for positioning the plastic injection drugs in a specified position, which ensures that only one plastic injection drug is cut off from the plastic injection drugs.

Preferably, plastic injection drugs are stored in a plurality of rows in the injection drug storing container with a partition member being provided at least between the plastic injection drugs in a lowermost row and in a next row, and when delivery of the plastic injection drugs in the lowermost row is completed, the partition member is operated to move the plastic injection drugs in the next row to the lowermost row.

Preferably, the partition member is composed of a plurality of partition vanes provided equally around a rotational axis, which enables feeding of attached plastic injection drugs at any time.

BRIEF DESCRIPTION OF THE DRAWINGS

FIG. 8A is a plan view showing the space container shown in FIG. 1;

FIG. 8B is a cross sectional front view of FIG. 8A;

FIG. 8C is a bottom view showing a disk of FIG. 8A;

FIG. 9A is a plan view showing a space container according to another example;

FIG. 9B is a cross sectional front view of FIG. 9A;

FIG. 9C is a bottom view showing a disk of FIG. 9A;

DETAILED DESCRIPTION OF THE INVENTION

Hereinbelow, an embodiment of the present invention will be described with reference to accompanying drawings.

Figure 1:
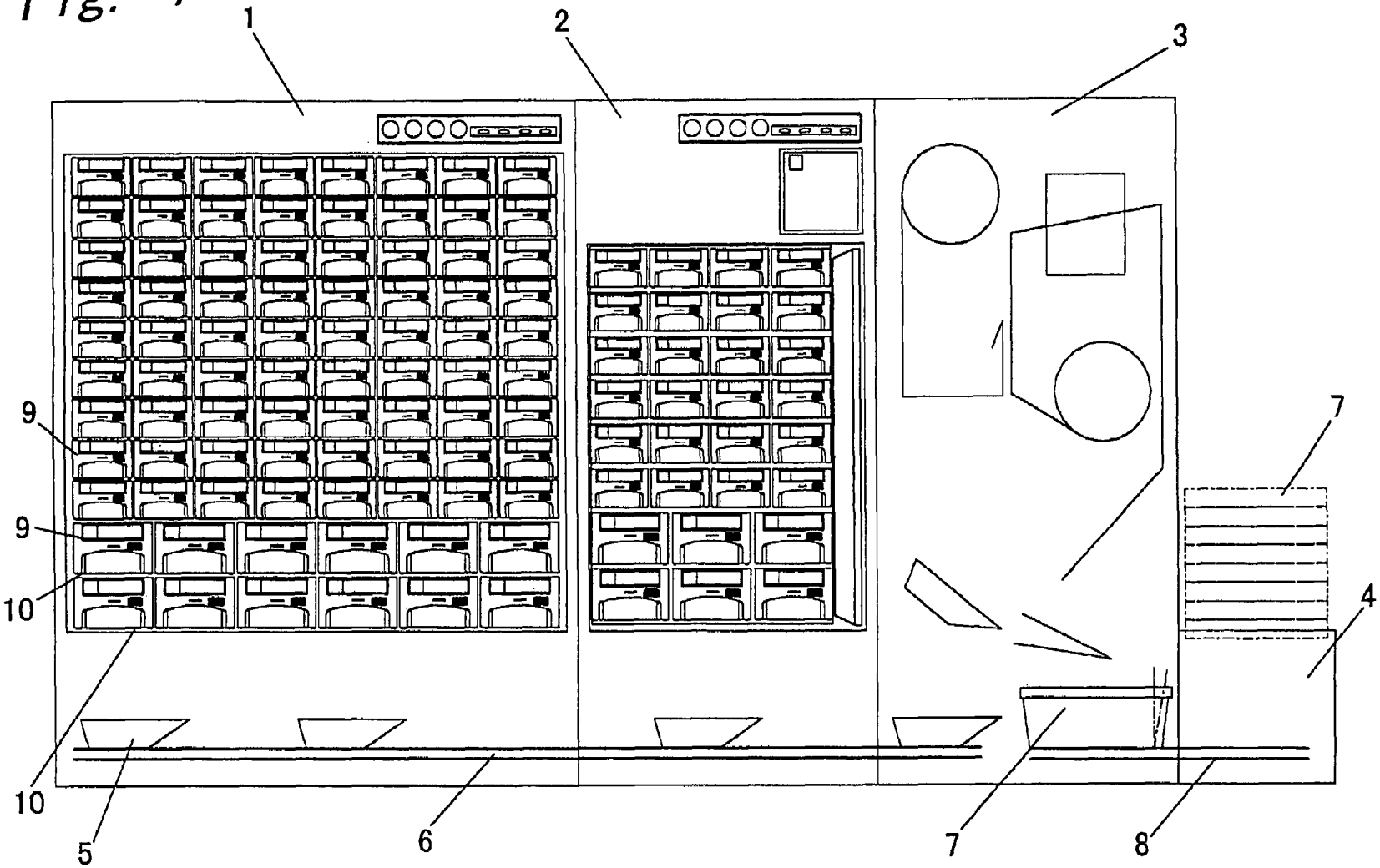
FIG. 1 is a front view showing an injection drug feeding device according to the present embodiment.

FIG. 1 is an injection drug feeding device according to the present embodiment. The injection drug feeding device is composed of an injection drug delivery device 1, a cold storing delivery device 2, a packing device 3, and a storage bucket stacking device 4. It is noted that the injection drugs fed by the injection drug feeding device are accommodated in the containers such as ampoules and vials, and those accommodated in the containers are generally referred to as injection drugs in the following description.

The injection drug delivery device 1 is structured such that an injection drug storing container 9 is detachably placed in each rack 10 disposed in a matrix configuration.

Figure 3:
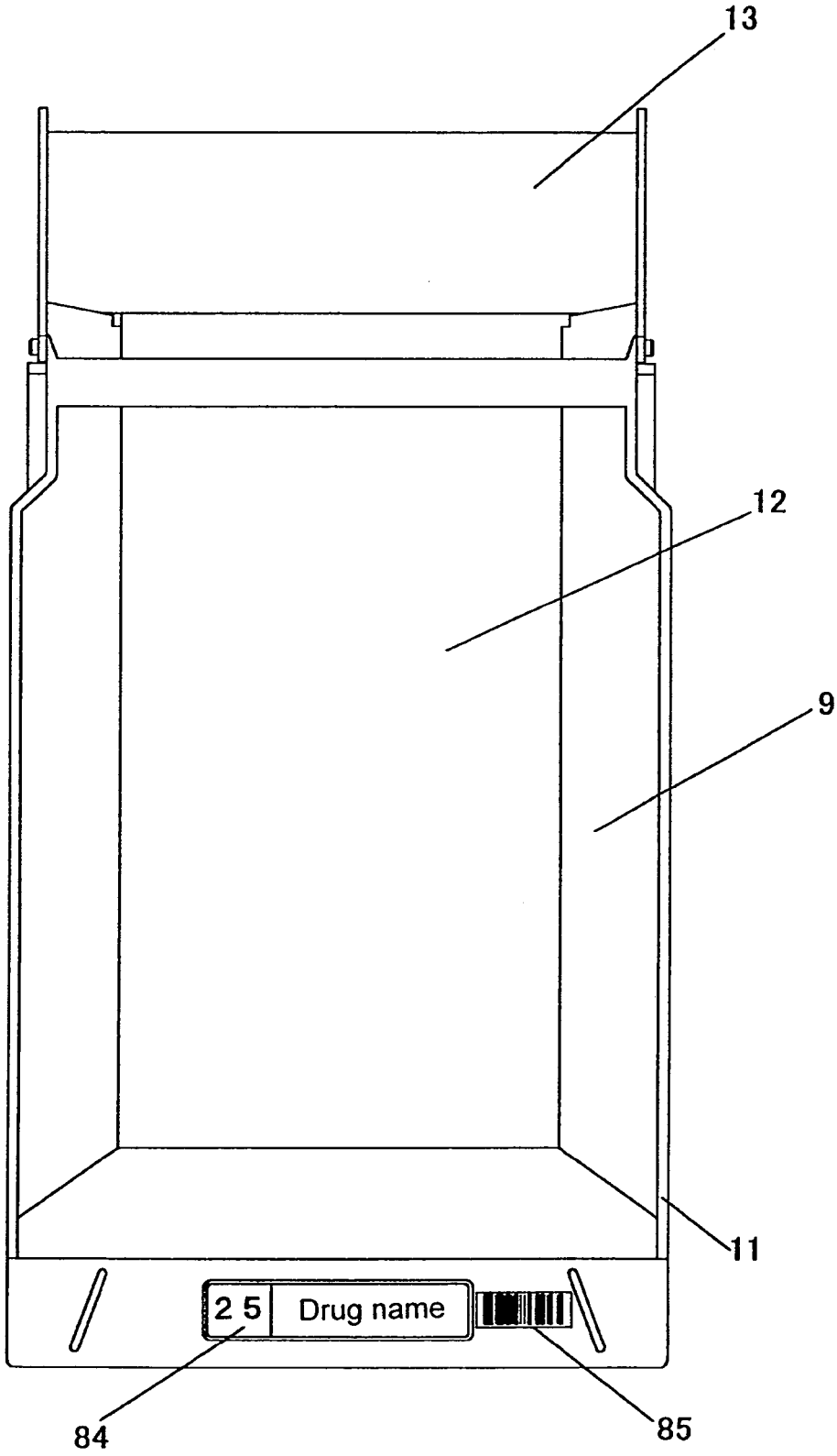
FIG. 3 is a plan view of an injection drug storing container shown in FIG. 1.
Figure 4:
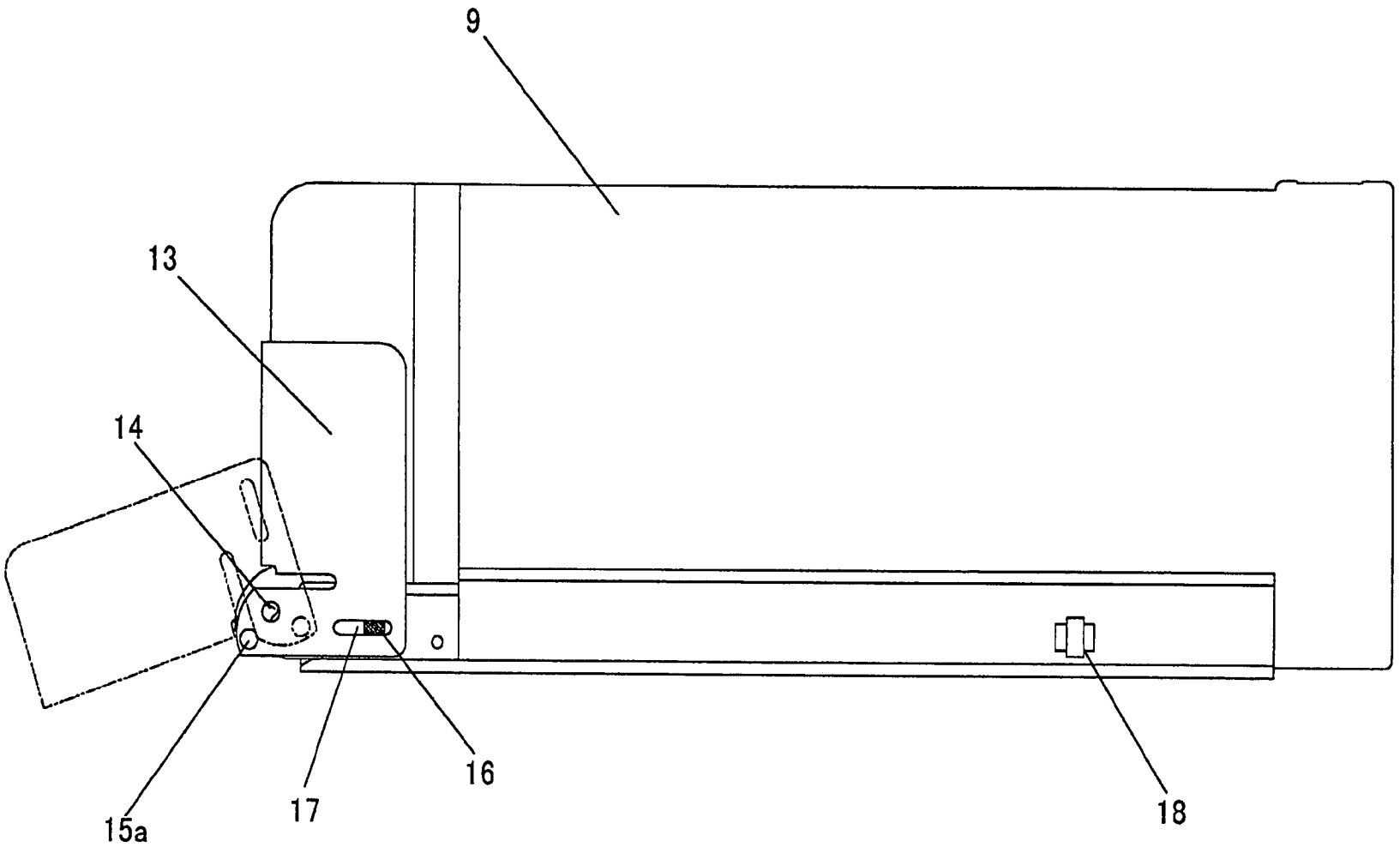
FIG. 4 is a side view of FIG. 3.

The injection drug storing container 9 is structured, as shown in FIG. 3 and FIG. 4, to have a conveyer belt 12 and a door 13 on a container main body 11. On one end portion of the container main body 11, an item name label 84 and a barcode label 85 are attached to the upper surface where visual confirmation is easy. The item name label 84 is for confirming whether the injection drug to be replenished in the injection drug storing container 9 is correct. Also, the barcode label 85 is for confirming whether the injection drug storing container 9 to be disposed in each rack 10 is correct. The conveyer belt 12 is disposed on the bottom portion of the container main body 11 for transporting the housed injection drugs to the door 13 side. The conveyer belt 12 allows adjustment by an adjust screw 18. The door 13 is provided on the other end side of the container main body 11 in a rotatable manner around a spindle 14 for allowing rotation in the range of approx. 120°. On both lateral sides of the door 13, there are formed an engagement hole 17 and guide protrusions 15*a*, 15*b* in the vicinity of the spindle 14. The engagement hole 17 engages with a lock hook 16 provided on the container main body 11 for keeping the door 13 in a state of closing an aperture portion on one end side of the container main body 11 at the time of engagement. The guide protrusions 15*a*, 15*b* slide on pilot guide grooves 19*a*, 19*b* having different shape, for opening and closing the door 13 in a later-described manner when the injection drug storing container 9 is inserted into and extracted from the rack 10.

Figure 6:
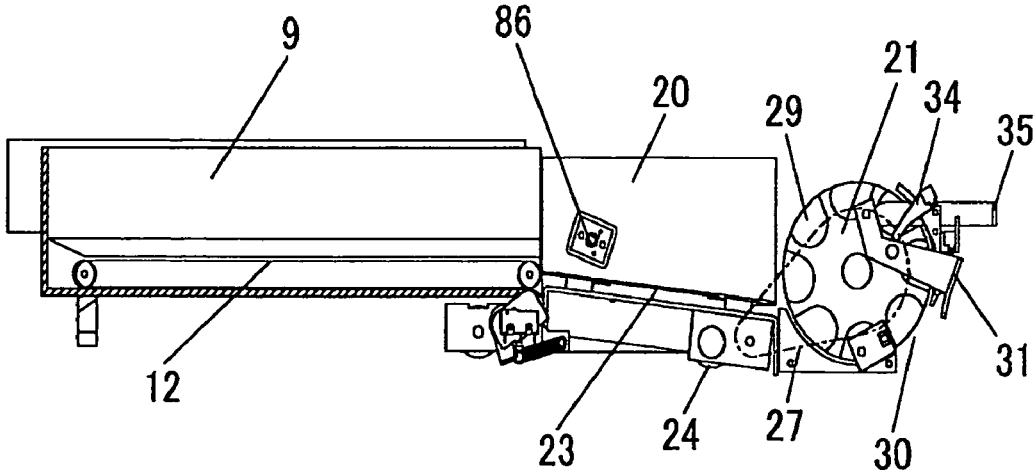
FIG. 6 is a side view showing the vicinity of the injection drug storing container and a space container shown in FIG. 1.

Each of the racks 10 is, as shown in FIG. 6, provided with a space container 20 and a rotating body 21 for taking out the injection drugs fed from the injection drug storing container 9 one by one.

The space container 20 is formed, as shown in FIG. 8, in the shape of a groove defined by facing lateral walls 22*a*, 22*b* and an inclined bottom face 22*c*. An injection drug detection sensor 86 is provided on the lateral wall 22*a* in the vicinity of an inlet. If an injection drug is not detected by the injection drug detection sensor 86, the conveyer belt 12 of the injection drug storing container 9 (FIG. 6) is driven to replenish injection drugs so that an appropriate amount of the injection drugs is present in the space container 20. It is noted that the injection drug detection sensor 86 is preferably operated for a specified period of time based on an instruction of injection drug delivery. Also, a disk 23 is rotatably provided on the bottom face of the space container 20. The disk 23 has an approximately conical shape that slightly protrudes from the bottom face. As shown in FIG. 9, an approximately oval-shaped rubber sheet 36 is preferably attached to the front face of the disk 23. In FIG. 9, a step portion 36*a* is formed on the rubber sheet 36, which can catch the injection drug so as to turn the injection drug sideways. Also, the disk 23 is reciprocally rotated via a driving gear 25 by driving a motor 24 provided on the bottom portion of the space container 20. This ensures sideway turning of the injection drug fed from the injection drug storing container 9, even if the drug has a long length like a 20 ml ampoule, which enables transportation of the drug with the use of a later-described rotating body 21. It is noted that the disk 23 is rotated at a low speed conforming to a rolling speed of the injection drug.

Figure 11:
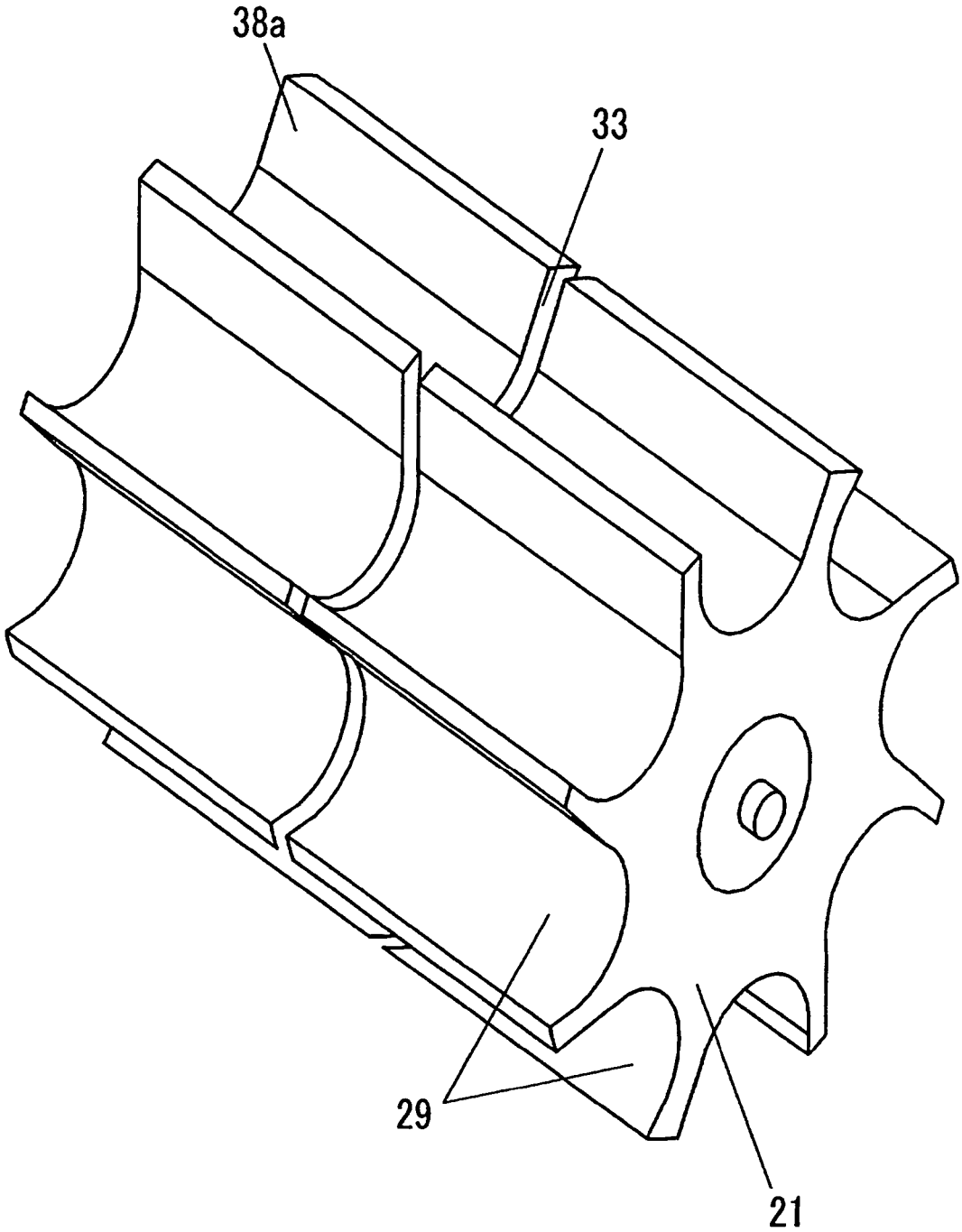
FIG. 11 is a perspective view showing a rotating body shown in FIG. 1.

As shown in FIG. 11, the rotating body 21 has a plurality of hollow grooves formed along a rotational axis in a circumferential direction at a constant pitch on a peripheral face, which form housing portions 29 for holding the injection drug. A partition portion 38*a* of adjacent housing portions 29 is formed into a recess shape inclined in a radial direction for smoothly introducing the injection drug into the housing portion 29 while appropriately holding only one injection drug when the rotating body 21 is rotated, which constitutes an auxiliary introduction portion according to the present embodiment. A sensor guide groove 33, is formed in a central portion of the rotating body 21. A sensor piece 34, shown in FIG. 8B, goes in and out of the sensor guide groove 33. When the injection drug is held in the housing portion 29, the sensor piece 34 is pressed by the peripheral face thereof and pushed out from the sensor guide groove 33. This makes it possible to determine whether the injection drug is housed in all of the housing portions 29. The rotating body 21 is rotatively driven by driving the motor 24 provided under the space container 20 via a pulley 26 and a belt 27. It is noted that an one-way clutch is provided on a rotational axis of the pulley 26 for rotating the pulley 26 only in one direction. It is noted that the motor 24 is driven until the sensor piece 34 detects that the injection drug is housed in all of the housing portions 29. After that, the motor 24 is driven in accordance with a delivery instruction.

Figure 10A:
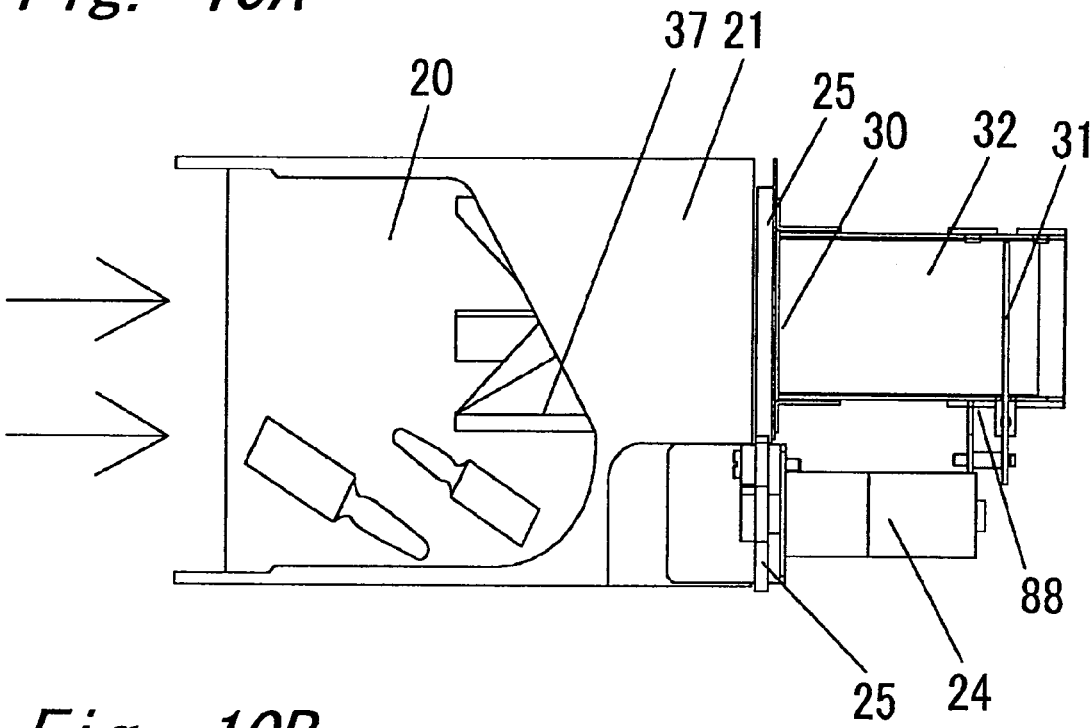
FIG. 10A is a plan view showing a space container according to another example.
Figure 10B:
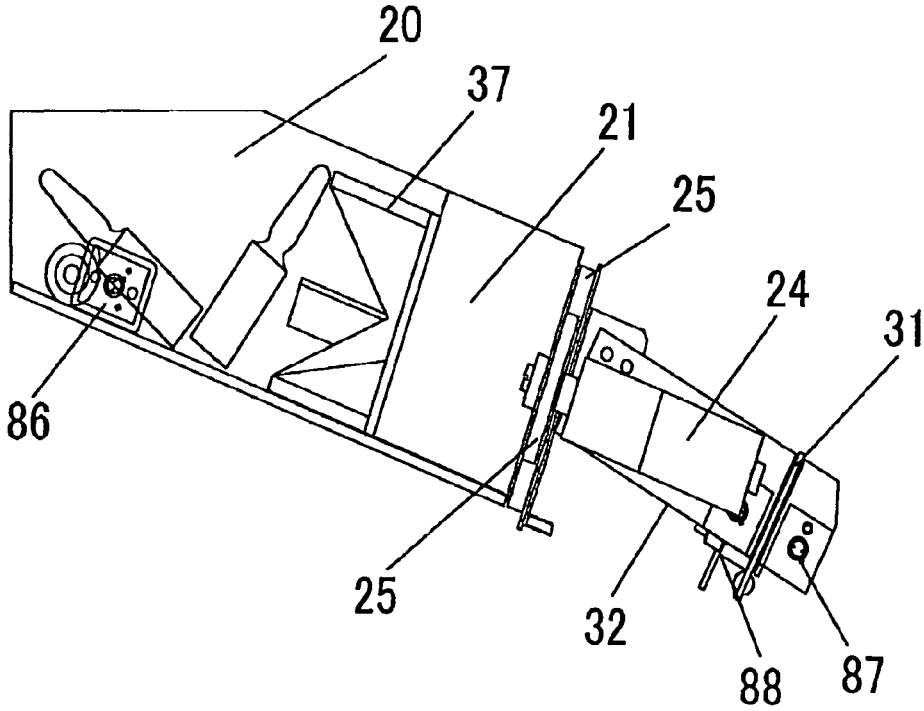
FIG. 10B is a plan view of FIG. 10A.
Figure 21:
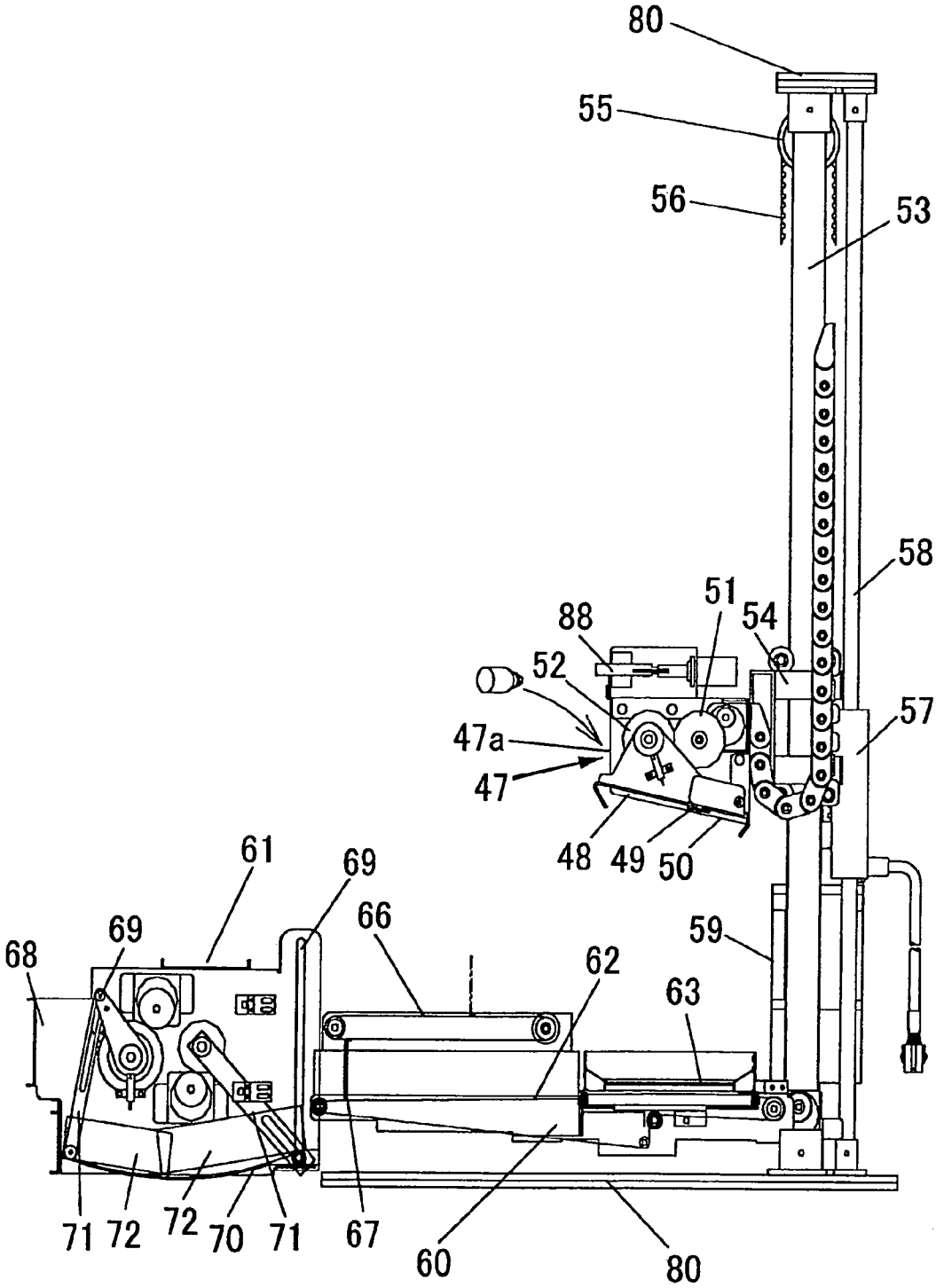
FIG. 21 is a front view showing a collection lifter according to the present embodiment.
Figure 22:
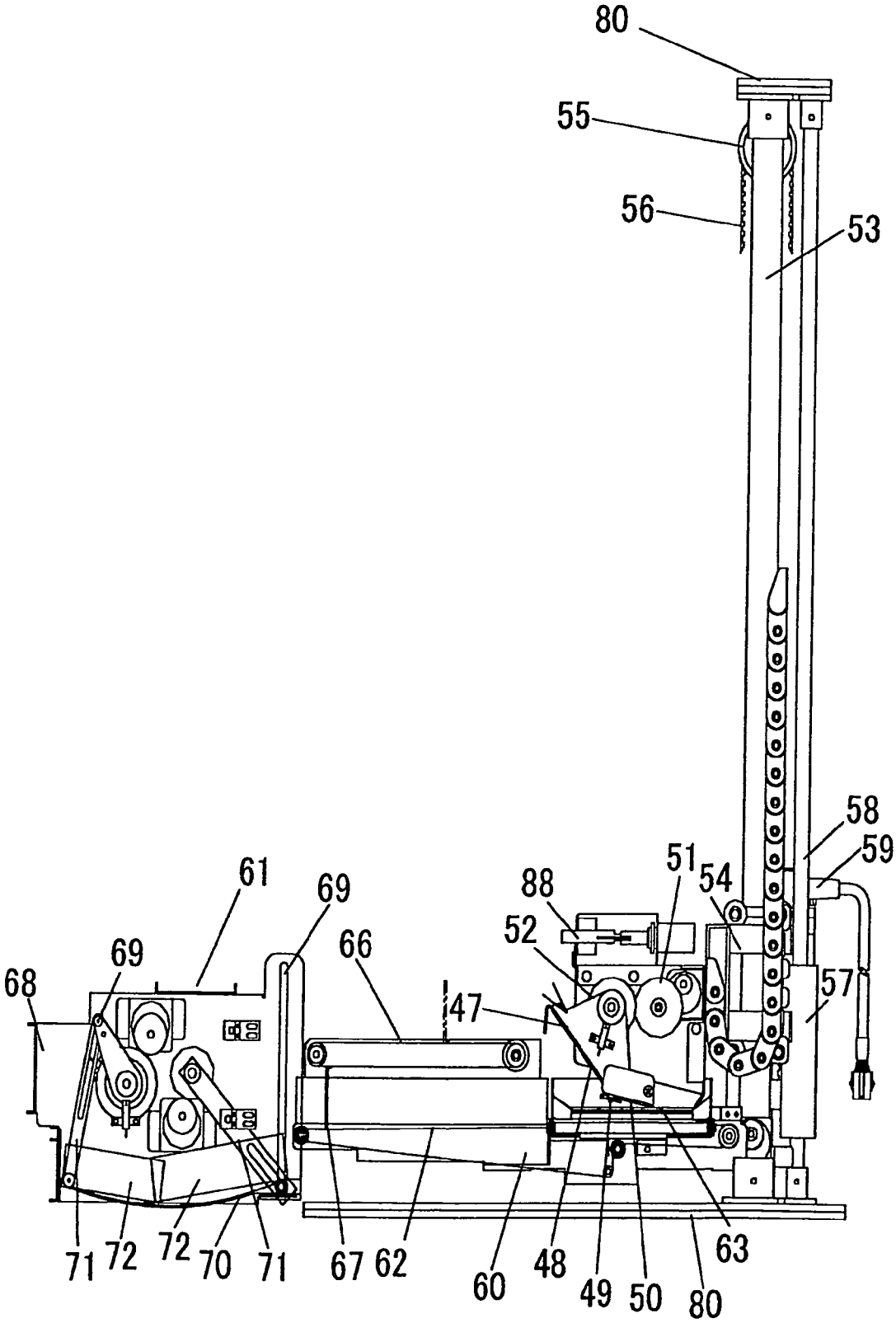
FIG. 22 is a front view showing an operating state from FIG. 21.

The injection drug held in the housing portion 29 of the rotating body 21 is, as shown in FIG. 21, delivered one by one by driving a solenoid 88 provided on a collection lifter 47 and by rotating a switching arm 35 for opening and closing a shutter 31 (FIGS. 10A-10B) provided on an outlet 30. The passing number of delivered injection drugs is counted by an injection drug count sensor 87 provided in the vicinity of the outlet 30.

As shown in FIG. 21, the collection lifter 47 has a lifter casing portion 47*a* whose bottom face is composed of a bottom plate 48 and a falling height absorber plate 50 rotatably connected by a hinge 49 for collecting the injection drugs delivered from the space container 20 via the rotating body 21. The bottom plate 48 is rotated by driving a switching motor 51 via a gear 52. As described above, the falling height absorber plate 50 is connected to a free end portion of the bottom plate 48 in a rotatable manner around a hinge 49, so as to rotate along the upper face of a collection conveyer 63. In the case where the falling height absorber plate 50 itself is composed of elastic-deformable materials such as sponges and brushes, connection by the hinge 49 is not necessary. Also on the upper portion of the collection lifter 47, there is provided a solenoid 88 for rotating a switching arm 35 of each rack 10. The collection lifter 47 is connected to a timing belt 56 hung over a vertical pulley 55 via an elevating supporting portion 54, and moves up and down along a guide rail 53 by driving an elevating motor 59. It is noted that reference numeral 57 denotes a weight for keeping weight balance with the collection lifter 47.

Figure 24:
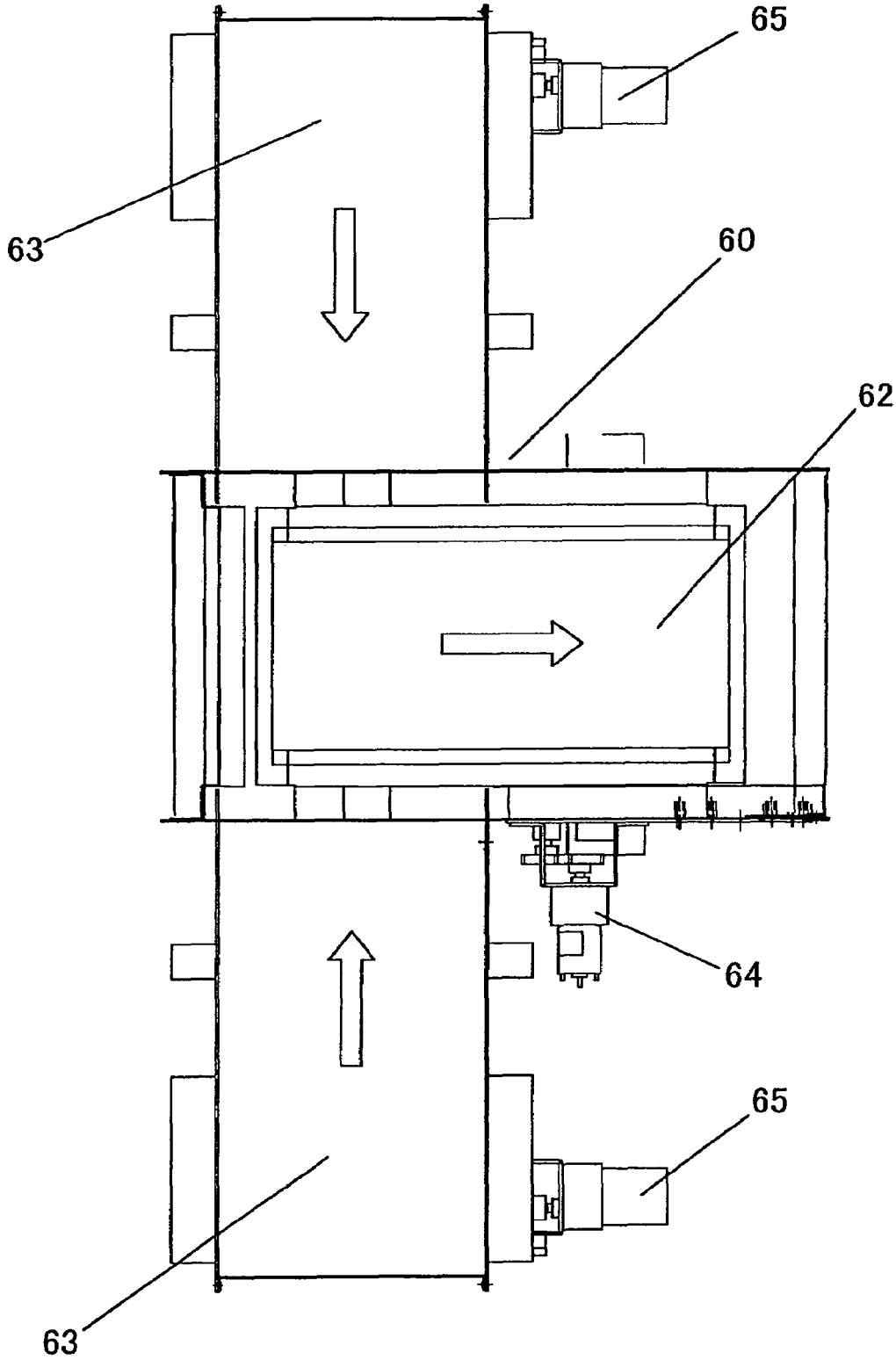
FIG. 24 is a front view showing a transportation conveyer unit according to the present embodiment.

Beneath the collection lifter 47, there is disposed a transportation conveyer unit 60. The transportation conveyer unit 60 is composed of a collection conveyer 63 and a central conveyer 62. The collection conveyer 63 is driven by a collection conveyer driving motor 65 for conveying injection drugs to the central conveyer 62. The central conveyer 62 is driven by a motor 64 (FIG. 24) for further conveying the injection drugs conveyed from the collection conveyer 63 to a transfer unit 61. Above the central conveyer 62, there are provided a pressure shutter belt 66 and a pressure shutter 67 that rotates together with the pressure shutter belt 66. It is noted that the configuration of the collection conveyer 63 and the central conveyer 62 in the transportation conveyer unit 60 is as shown in FIG. 24.

Figure 26:
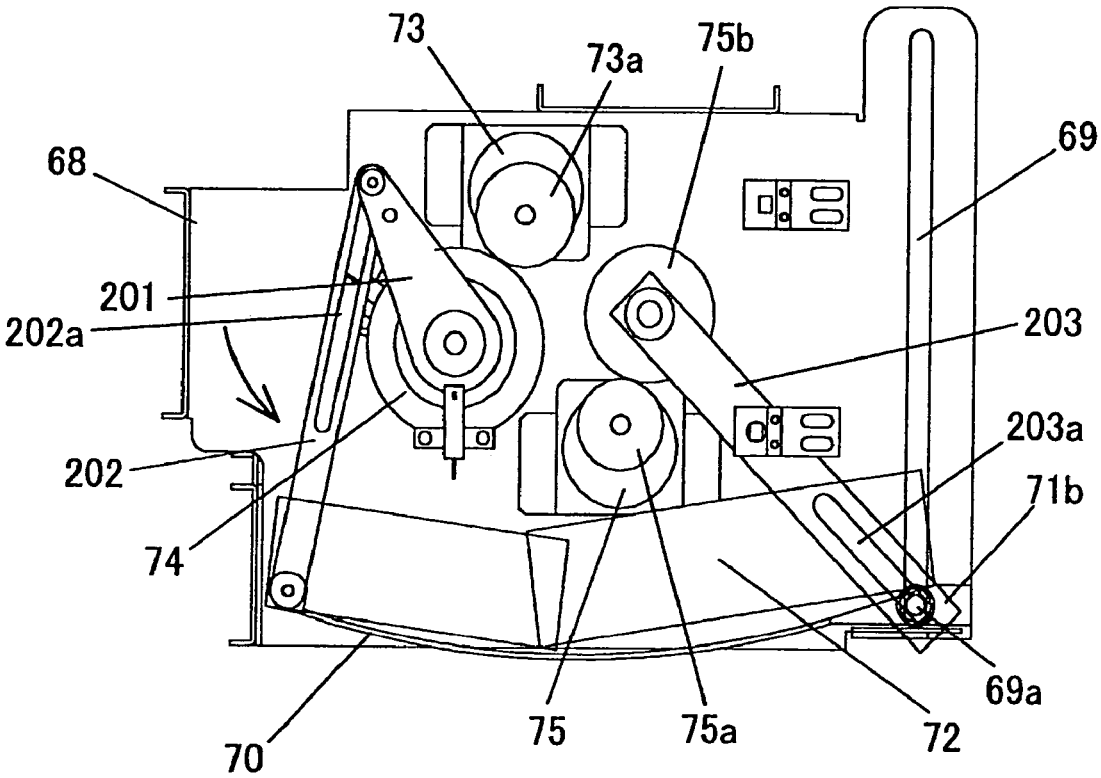
FIG. 26 is a front view showing a transfer unit according to the present embodiment.

As shown in FIG. 26, the transfer unit 61 has a frame body 68 whose bottom face is composed of an openable bottom sheet 70, and is moved up and down by an unshown elevating device. On one end portion of the frame body 68, there is formed an axis elevating portion 69 that extends vertically. In the central portion of the frame body 68, there are formed motors 73 and 75. A gear 73*a* engaged with a gear 74 is provided on a rotational axis of the motor 73. The gear 74 is provided with an arm 201, whose end portion is rotatably connected to one end portion of the bottom sheet 70 via a link 202. The end portion of the arm 201 is slidably connected to a long hole 202*a* of the link 202. On the rotational axis of the motor 75, there is fixed a gear 75*a* engaged with a gear 75*b*. The gear 75*b* is rotatably connected to one end portion of a link 203. On the other end side of the link 203, there is formed a long hole 203*a*, which is slidably connected to an axis portion 69*a* provided on the axis elevating portion 69 so as to enable rising and falling. A pair of guide containers 72 is provided on the upper face of the bottom sheet 70. Each of the guide containers 72 is in the shape of an approximate C letter cross section for preventing the injection drug from falling. It is noted that the bottom sheet 70 and the guide container 72 may be composed of an elastic material such as brushes and sponges.

A packing device 3 is provided for packing an injection drug delivered from delivery devices 1 and 2. A storage bucket stacking device 4 is provided for storing a packed injection drug in a bucket 7.

Figure 30A:
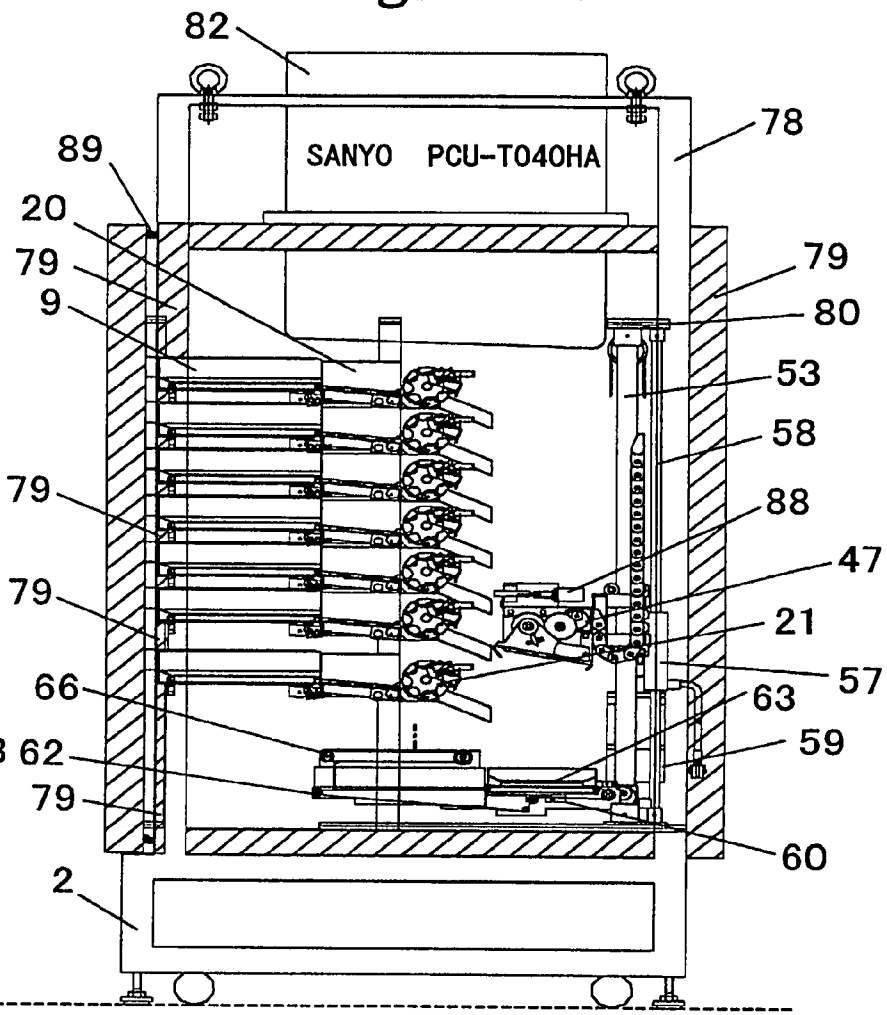
FIG. 30 is a front view and a side view showing a cold storing delivery device according to the present embodiment.
Figure 30B:
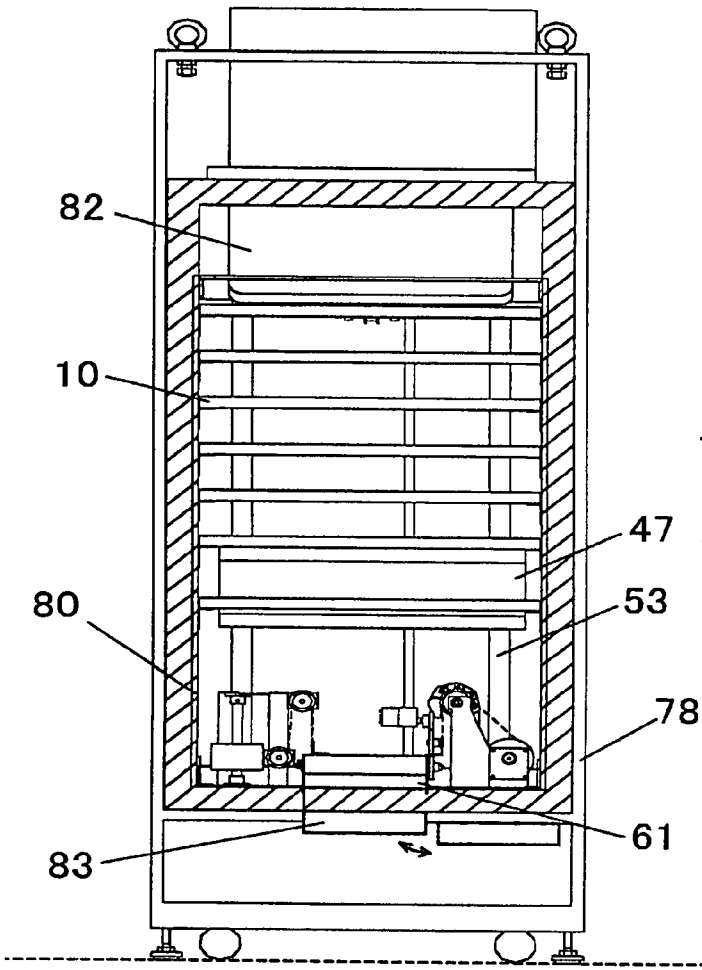

The cold storing delivery device 2 is provided for delivering a special injection drug which is specified to be stored in a cold place and a dark place. As shown in FIGS. 30A and 30B, the cold storing delivery device 2 is provided with a heat insulating plate 79 and a cooling device 82 (e.g., PCU-TO40HA made by SANYO) mounted on a casing frame 78 for forming a cold reserving space (5° C.±2° C.) inside. In the cold reserving space, a support casing 80 is provided along the inner face. The support casing 80 supports transportation means such as the injection drug storing container 9, the space container 20, the rotating body 21, the collection lifter 47, the transportation conveyer unit 60 and the transfer unit 61. The cold reserving space is openable by a front door 79 made from a heat insulating material. In the front door 79, a double glazing is embedded for enabling confirmation of an operating state inside. Whether or not the injection drug is stored in the injection drug storing container 9 is indicated on an indication device (not shown) based on a detection result by the sensor piece 34 and the like. Each rack 10 is formed from a high thermal conductive material and provided with an aperture portion for enabling sufficient circulation of cold air from the cooling device 82. Further, beneath the transfer unit 61, an input door 83 is slidably provided for enabling transfer of the injection drug to an injection drug collection bucket 5 with the door being drawn out. This makes it possible to minimize the escape of cold air. Also on the peripheral portion of the input door 83, there is provided a gutter (not shown) for recovering dew condensation water. For effective recovery of dew condensation water, the input door 83 is preferably stopped temporarily in the state of being slightly opened.

Figure 2:
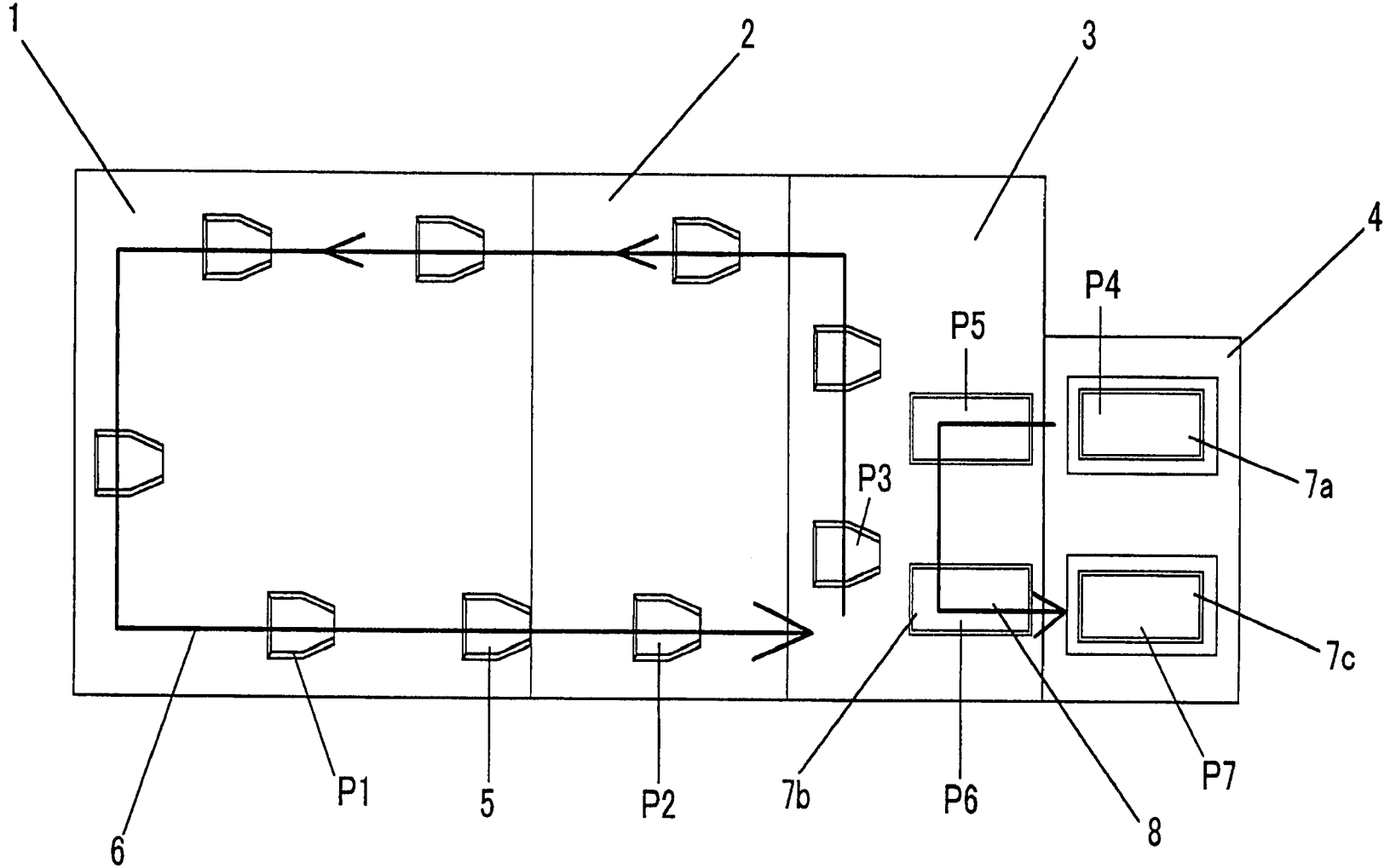
FIG. 2 is a plan view showing a transportation route of a bucket in the injection drug feeding device shown in FIG. 1.

On the lowermost portion of the delivery devices 1, 2, and the packing device 3, there is provided a transportation line 6 for moving a plurality of injection drug collection buckets 5 in a circulating manner as shown in FIG. 2. In the transportation line 6, the injection drugs delivered from the delivery devices 1 and 2 are each collected in positions P1 and P2. In a position P3, the injection drugs in the injection drug collection bucket 5 are lifted away from the transportation line 6, and packed in the packing device 3. On the lowermost portion of the packing device 3 and the storage bucket stacking device 4, there is provided a transportation line 8. In the transportation line 8, a storage bucket 7 fed in a position P4 of the storage bucket stacking device 4 is moved to a position P5, where packed injection drugs are collected. A fully loaded storage bucket 7 is transported from a position P6 to a position P7.

The following description discusses operation of the above-structured injection drug feeding device.

When injection drug prescription data is input by an unshown host computer or input means, it is determined whether or not an appropriate injection drug is feedable. The determination is made based on stock management data preset in the computer during mounting of the injection drug storing container 9, detection results of the sensor piece 34, and the like. If it is determined that an appropriate injection drug is not present or is in short supply, a corresponding injection drug storing container 9 is detached from the rack 10 for replenishment.

Figures 5A, 5B, 5C, 5D, 5E:
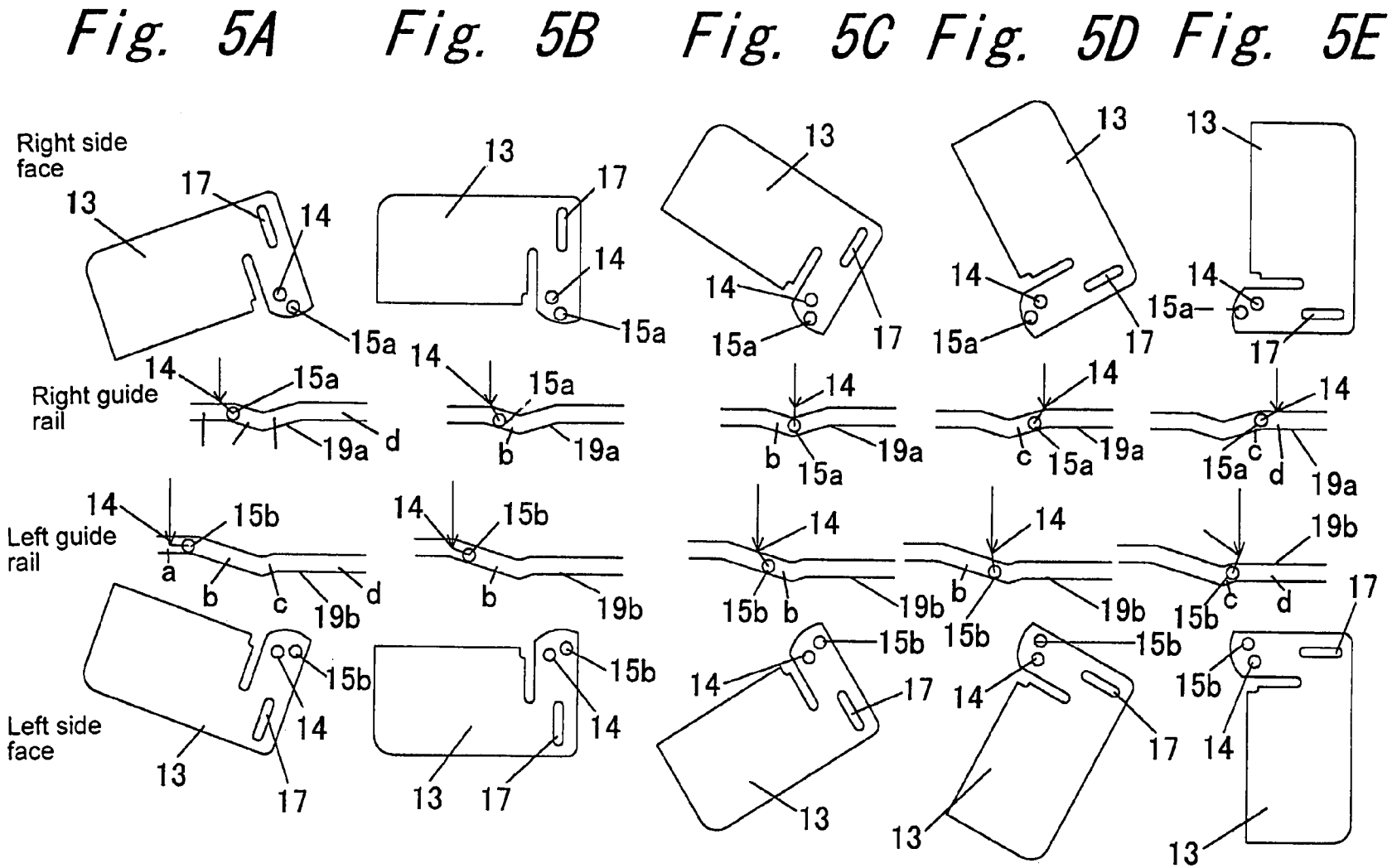
FIGS. 5A-5E are schematic views showing opening operation of a door on the injection drug storing container shown in FIG. 1.

When the injection drug storing container 9 is mounted on the rack 10, the door 13 is fully opened and the guide protrusions 15*a*, 15*b* are positioned in a first horizontal portion a of the pilot guide grooves 19*a*, 19*b* as shown in FIG. 5A. When the injection drug storing container 9 is extracted from the rack 10, first as shown in FIG. 5B, the guide protrusions 15*a*, 15*b* pass a first inclined portion b of the pilot guide grooves 19*a*, 19*b* so that the door 13 rotates about a spindle 14 until it reaches a horizontal position. Then as shown in FIG. 5C, when the guide protrusion 15*b* moves from the first inclined portion b to a second inclined portion c, the guide protrusion 15*a* passes the first inclined portion b. Consequently, when the guide protrusion 15*b* turns from the first inclined portion b to the second inclined portion c, the door 13 smoothly gets up without being caught in the curved portion. Next as shown in FIG. 5D, when the guide protrusion 15*a* moves from the first inclined portion b to the second inclined portion c, the guide protrusion 15*b* passes the second inclined portion c. In this case like the previous case, the guide protrusion 15*a* will not be caught in the curved portion in an interface between the first inclined portion b and the second inclined portion c, thereby enabling the door 13 to smoothly move up. After that as shown in FIG. 5E, the guide protrusions 15*a*, 15*b* reach a second horizontal portion d of the pilot guide grooves 19*a*, 19*b*, and the engagement hole 17 engages with the engagement piece 16 for keeping the door 13 in a closed state. Therefore, when the injection drug storing container 9 is in the state of being extracted from the rack 10, the injection drug remaining inside will not spring out.

Thus, when the injection drug storing container 9 is extracted from the rack 10, appropriate injection drugs of the same kind are stored therein and the container is remounted on the same rack 10. At this time, the kind of injection drugs stored in the injection drug storing container 9 are identified by an item name label 84, while the rack 10 on which the injection drug storing container 9 is mounted is confirmed by reading a barcode label 85 with a barcode reader (not shown). It is noted when mounting, the rotating operation of the door 13 of the injection drug storing container 9 is changed from the state shown in FIG. 5E to the state shown in FIG. 5A in contrast to the above case in which the door 13 is fully opened.

If an appropriate injection drug is feedable based on the injection drug prescription data, it is determined whether or not the injection drug is housed in all of the housing portions 29 of the rotating body 21 with the use of the sensor piece 34. If the injection drug is not housed in all of the housing portions 29, the injection drugs in the space container 20 are transported by the conveyer belt 12. At this point, the disk 23 is reciprocally rotated by driving the motor 24 for turning the injection drug sideways so as to facilitate housing of the injection drug in the housing portion 29 of the rotating body 21. Since driving of the motor 24 starts rotation of the rotating body 21, the injection drugs are turned sideways by the disk 23 and sequentially housed in the empty housing portions 29. This enables efficient feeding of the injection drugs.

Next as shown in FIG. 21, the collection lifter 47 is driven so as to move to a specified rack 10, where the solenoid 88 is driven to open or close the shutter 31 via the switching arm 35. This enables sequential discharge of the injection drugs held in each housing portion 29 of the rotating body 21 from the outlet 30. The number of discharged injection drugs is counted by the sensor 87, and the motor 24 or the like is stopped when the number reaches a set number.

Figure 23:
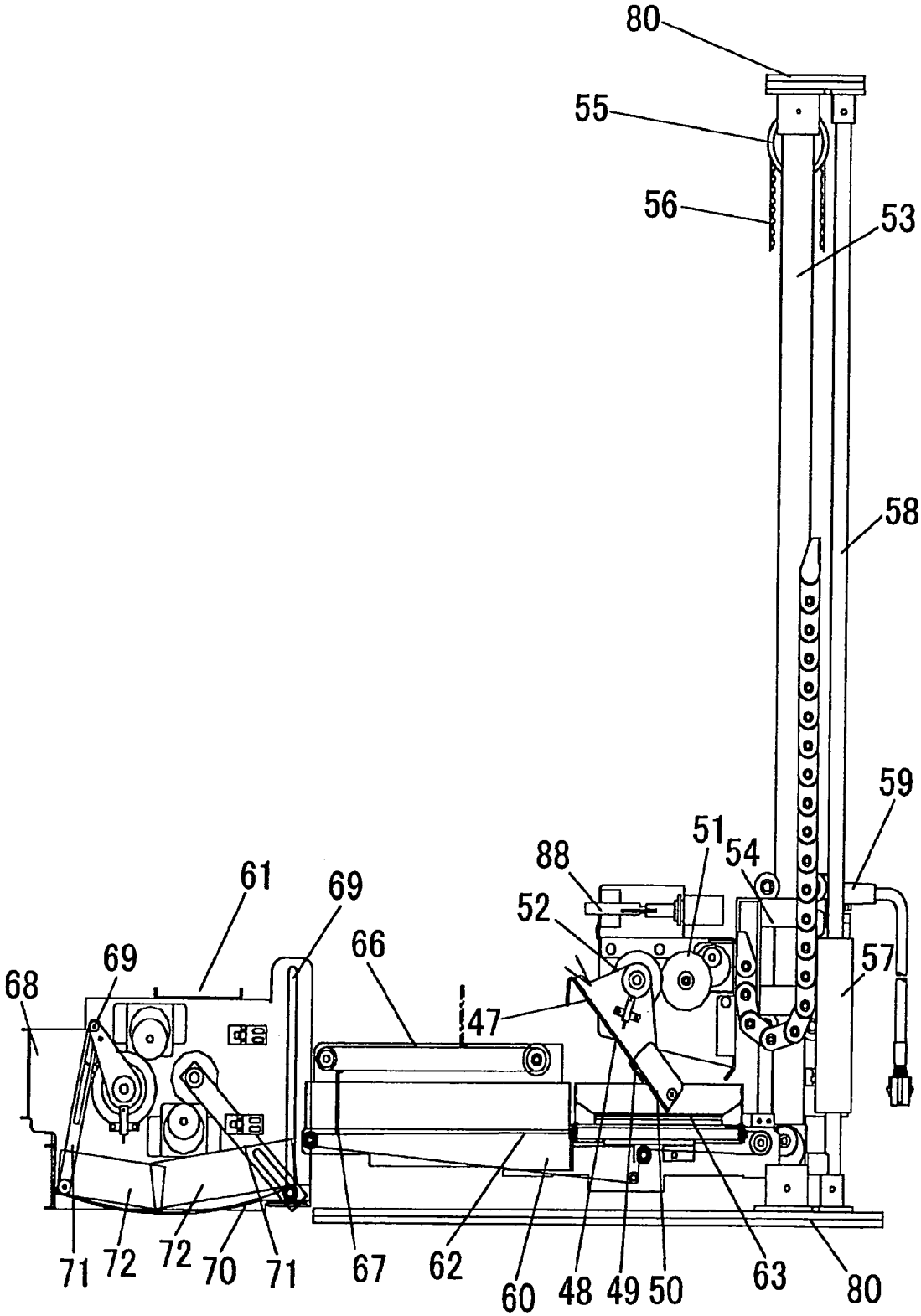
FIG. 23 is a front view showing an operating state from FIG. 22.

The collection lifter 47 that collected the injection drugs sequentially delivered from the rotating body 21 is lowered by driving the elevating motor 59, and stopped in the upper vicinity of the collection conveyer 63 of the transportation conveyer unit 60. Here, the switching motor 51 is driven to open the bottom plate 48 for feeding the injection drugs onto the collection conveyer 63 while the falling height absorber plate 50 is placed along the upper face of the collection conveyer 63. Then as shown in FIG. 23, the elevating motor 59 is reversed to raise the collection lifter 47 for the purpose of shifting all the injection drugs in the collection lifter 47 onto the collection conveyer 63 in sequence. This enables a smooth shift of the injection drugs onto the collection conveyer 63 without exerting impact to the injection drugs. Also the collection lifter 47 moves to an appropriate rack 10 by driving the elevating motor 59 for collecting the next injection drugs. At this point, the switching motor 51 is driven to close the bottom face with the bottom plate 48.

Figure 25A:
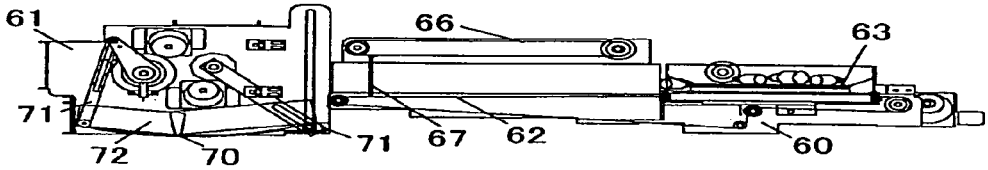
FIGS. 25A and 25F are front views showing an operating state of the transportation conveyer unit according to the present embodiment.
Figure 25B:
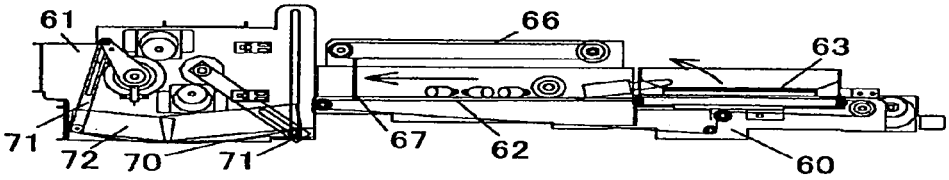
Figure 25C:
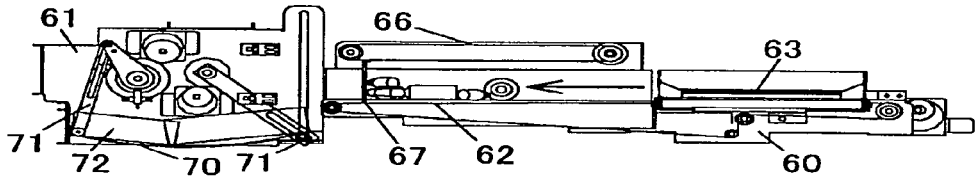
Figure 25D:
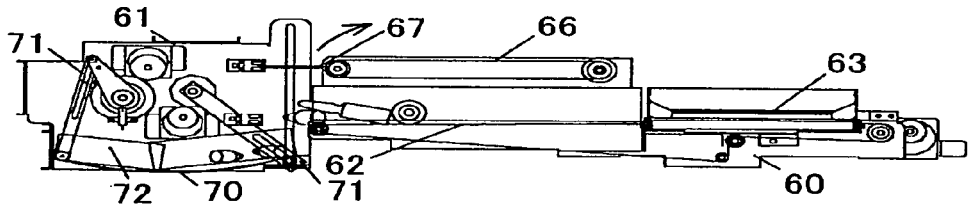
Figure 25E:
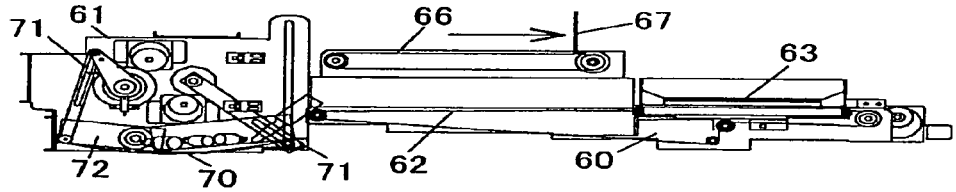
Figure 25F:
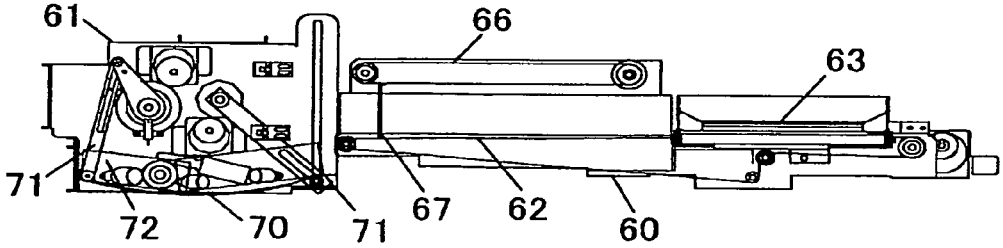

The collection conveyer 63 transports the injection drugs transferred from the collection lifter 47 as shown in FIG. 25A to the central conveyer 62 as shown in FIG. 25B. On the central conveyer 62, the injection drugs are temporarily retained by the pressure shutter 67 as shown in FIG. 25C. When the transfer unit 61 is ready to receive the injection drugs, the pressure shutter belt 66 is driven to release the pressure shutter 67 as shown in FIG. 25D to transport the injection drugs to the transfer unit 61. Here, as shown in FIG. 25E to FIG. 25F, the pressure shutter belt 66 is continuously driven to make the pressure shutter 67 go round and return to the previous position. This makes it possible to ensure transportation of the injection drugs on the central conveyer 62 into the transfer unit 61.

Figure 27:
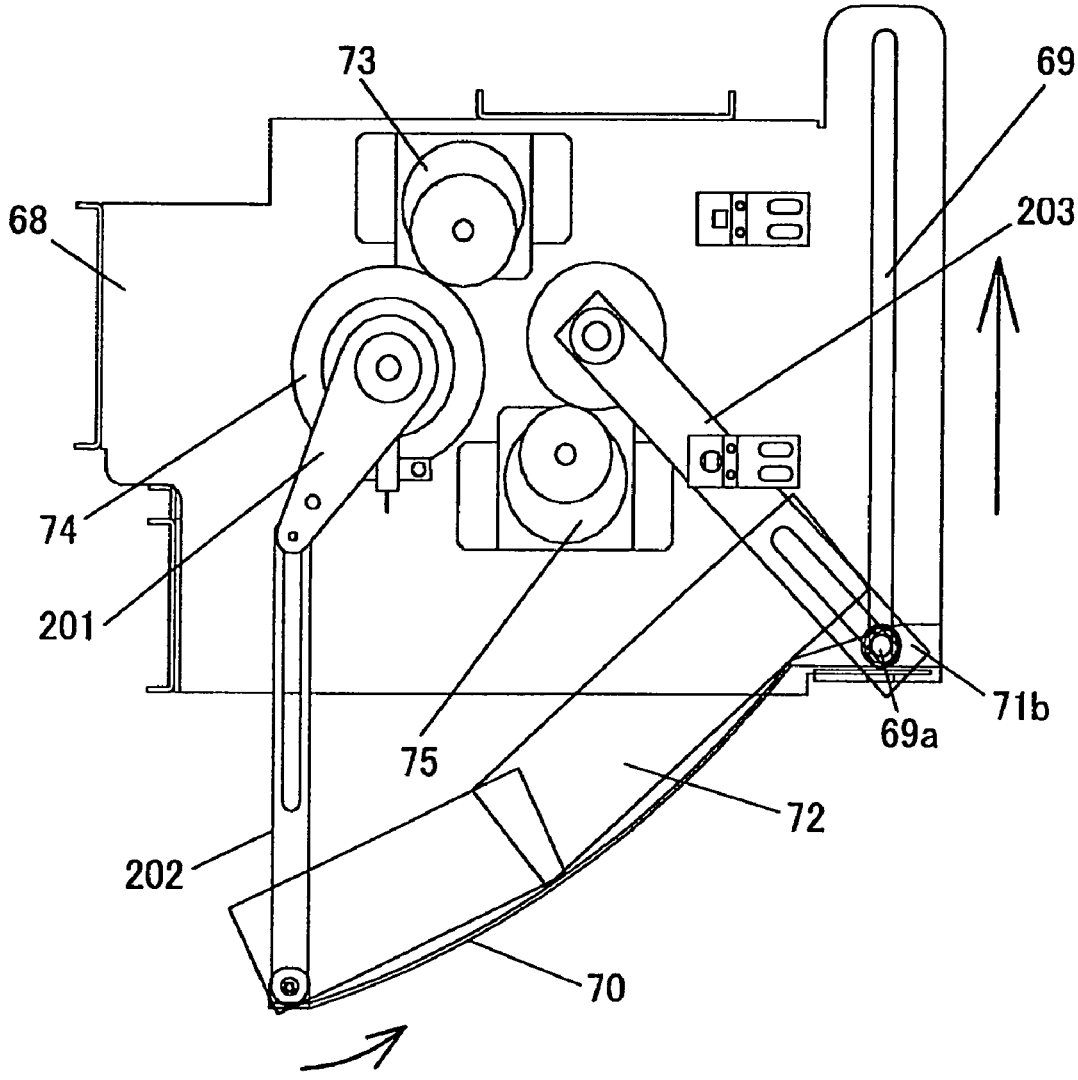
FIG. 27 is a front view showing an operating state from FIG. 26.
Figure 28:
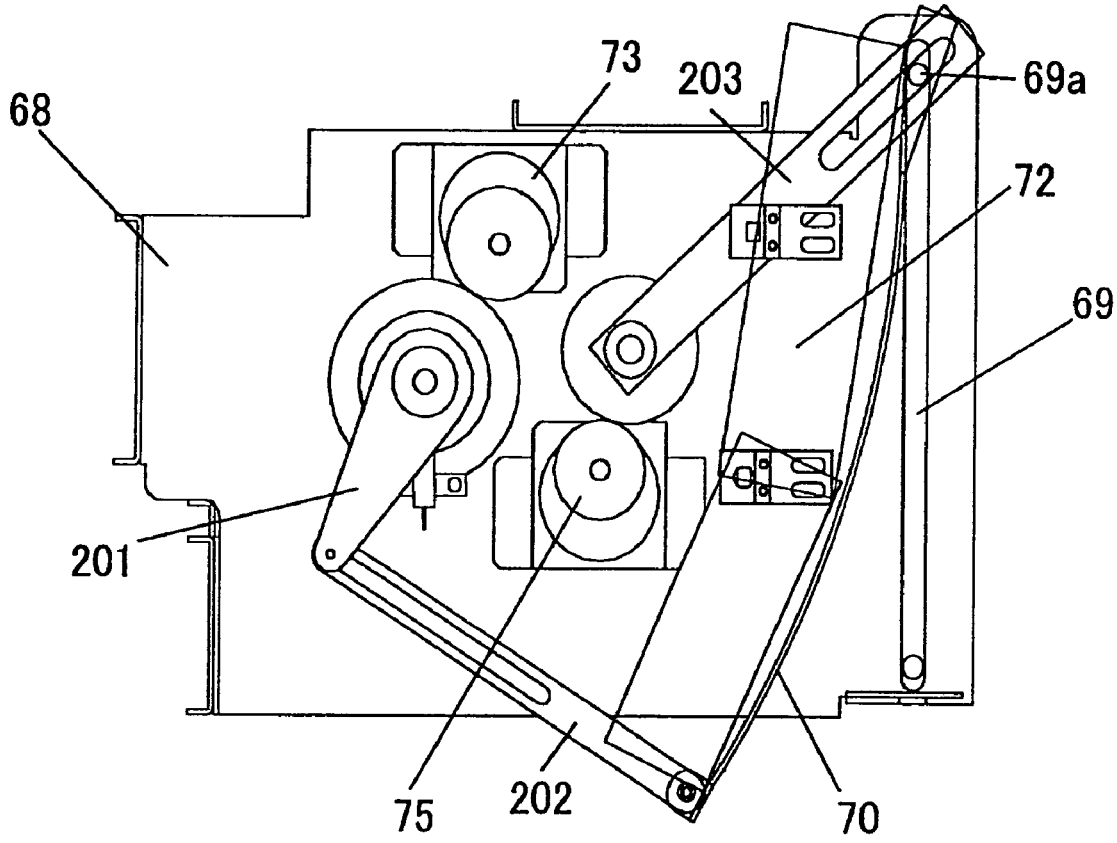
FIG. 28 is a front view showing an operating state from FIG. 27.
Figure 29:
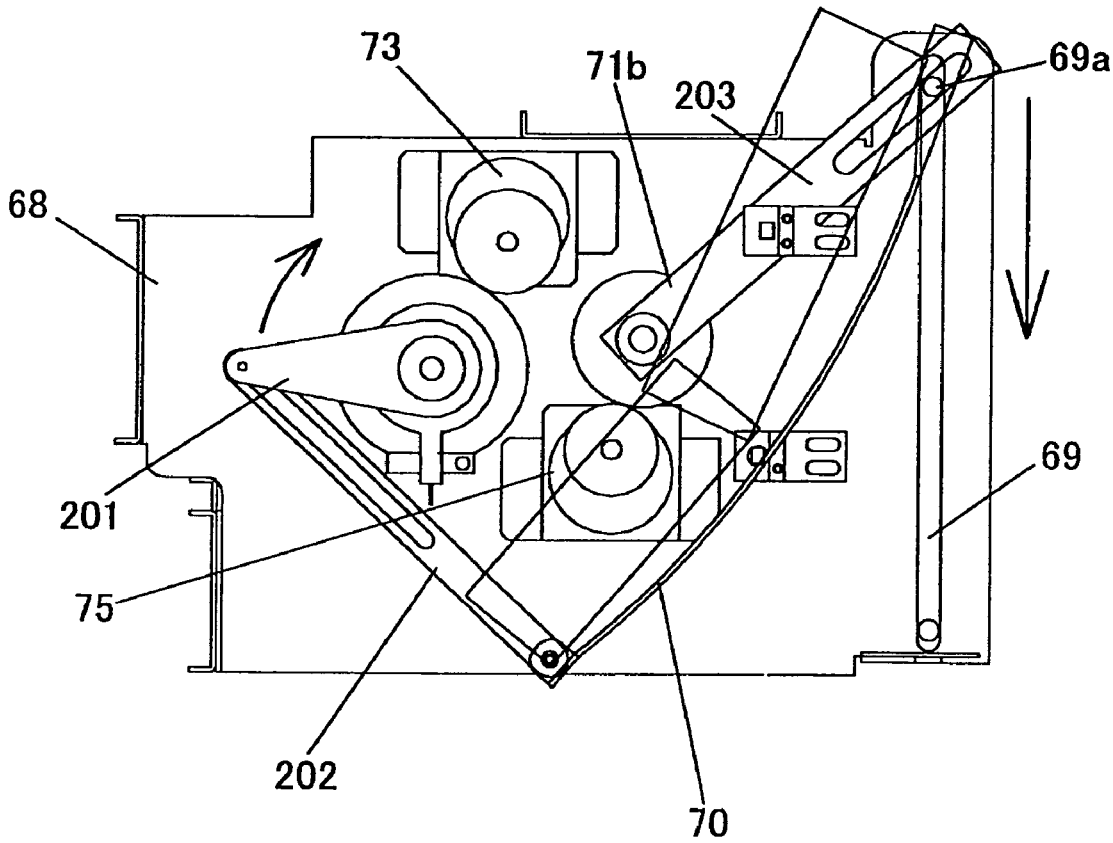
FIG. 29 is a front view showing an operating state from FIG. 28.

The transfer unit 61 is raised and lowered by an elevating device (not shown) and stopped in a position close to the bottom face of the injection drug collection bucket 5. Then, a first transfer motor 73 is driven to rotate the bottom sheet 70 and the guide container 72 around an axis portion 69*a* via the arm 201 and the link 202 as shown in FIG. 27 for opening the bottom face. Consequently, the injection drugs are transferred to the injection drug collection bucket 5. Further, the first transfer motor 73 is continuously driven, while at the same time a second transfer motor 75 is driven in order to raise the axis portion 69*a* along the axis elevating portion 69, so that a maximum inclination angle is imparted to the bottom sheet 70 and the guide container 72 for transferring all the injection drugs to the injection drug collection bucket 5 as shown in FIG. 28. When transfer of the injection drugs to the injection drug collection bucket 5 is completed, the first transfer motor 73 is reciprocally driven, and after the link 203 is moved, the second transfer motor 76 is reciprocally driven as shown in FIG. 29 to return to the original position as shown in FIG. 26.

Figure 7:
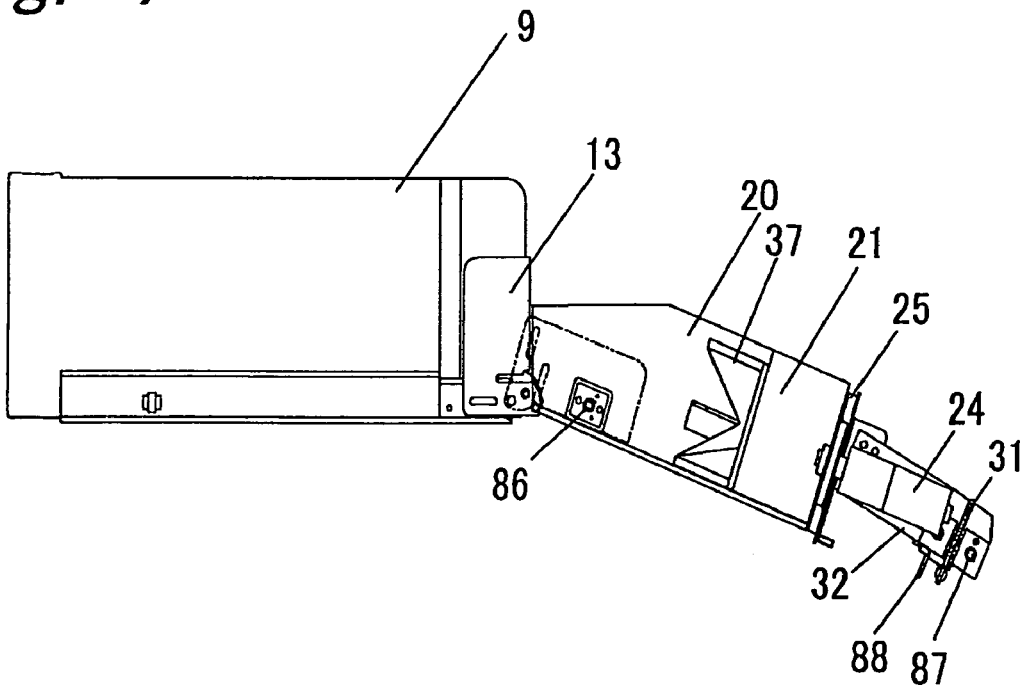
FIG. 7 is a side view showing the vicinity of an injection drug storing container and a space container according to another example.

Although in the above embodiment, the rotating body 21 is disposed so that the center of an axis is parallel to the longitudinal direction of an injection drug to be transported, the rotating body 21 may be disposed orthogonal thereto as shown in FIG. 7 and more specifically in FIG. 10.

More particularly, the rotating body 21 is provided on the space container 20 and is rotatively driven by driving the motor 24 via the driving gear 25. In the vicinity of the outlet 30 of the rotating body 21, a chute 32 is connected. The chute 32 is opened and closed by the solenoid 88.

The rotating body 21 is provided with a blade member 37 on the introduction portion, so that an injection drug mounted on the blade member 37 slides in the longitudinal direction of the injection drug upon rotation of the rotating body so as to be introduced into the housing portion 29.

One injection drug is stored in the chute 32 and others are stored in a plurality of the housing portions 29 provided on the rotating body 21.

Also the rotating body 21 employed in FIG. 7 is not limited to the one having the structure shown in FIG. 11, but those having the structures shown in FIG. 12, FIG. 17, FIG. 31, and FIG. 32 are also applicable.

Figure 12:
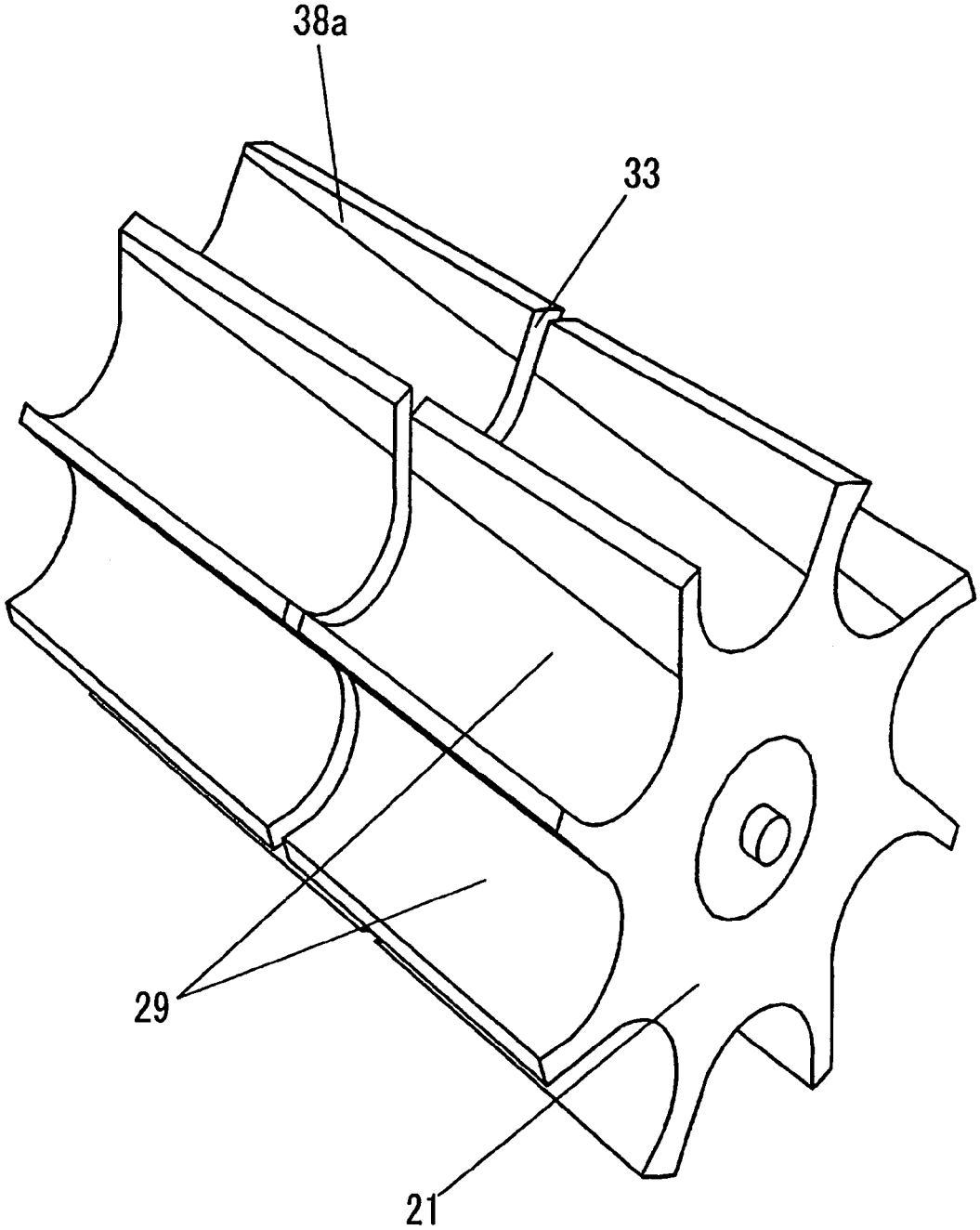
FIG. 12 is a perspective view showing a rotating body in another example.

A rotating body 21 shown in FIG. 12 has a conical shape with a depth of the housing portion 29 being gradually decreased toward one end side. More particularly, the height of a partition portion 38*a* is restrained in order to facilitate introduction of injection drugs.

Figure 13:
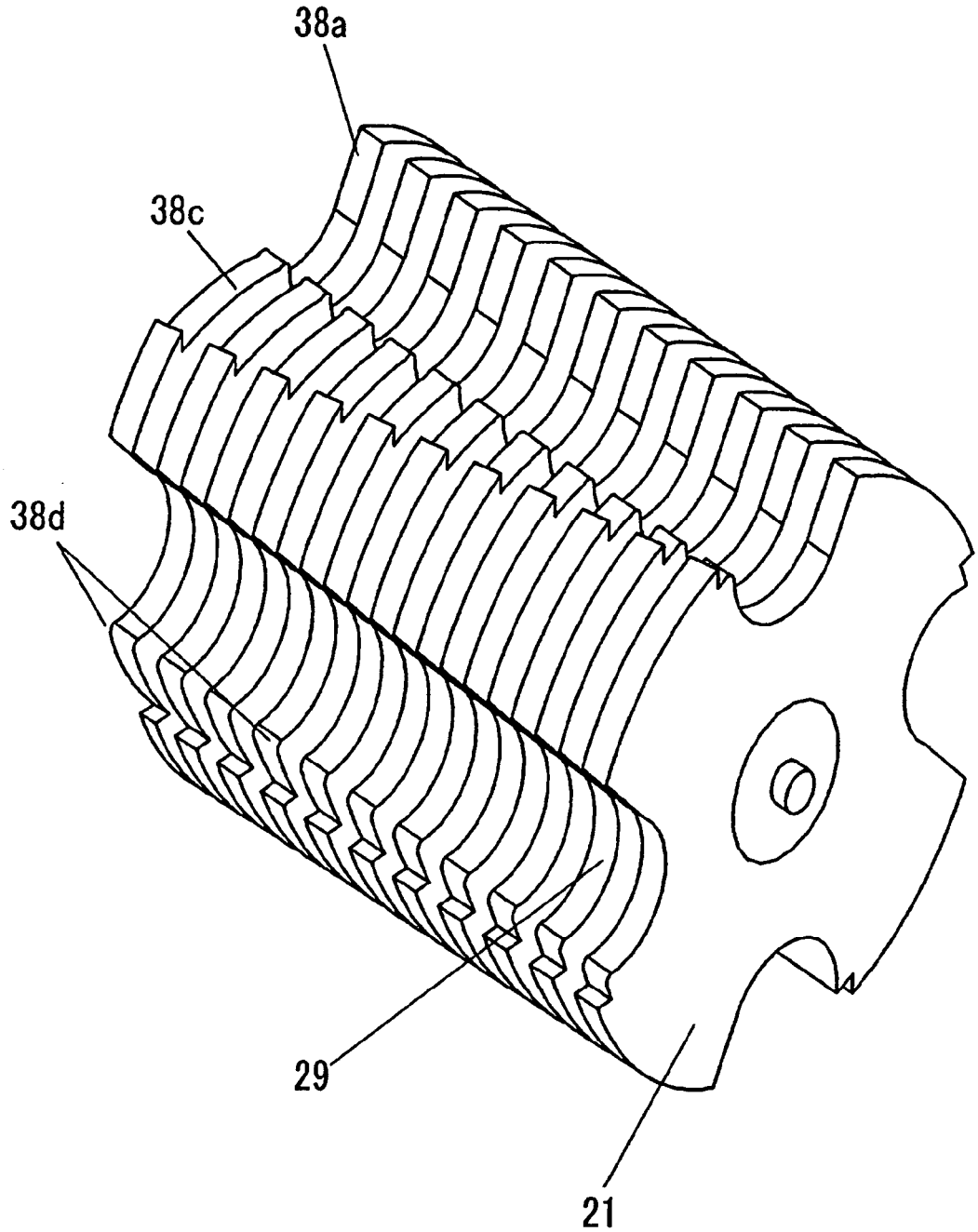
FIG. 13 is a perspective view showing a rotating body in another example.
Figure 16:
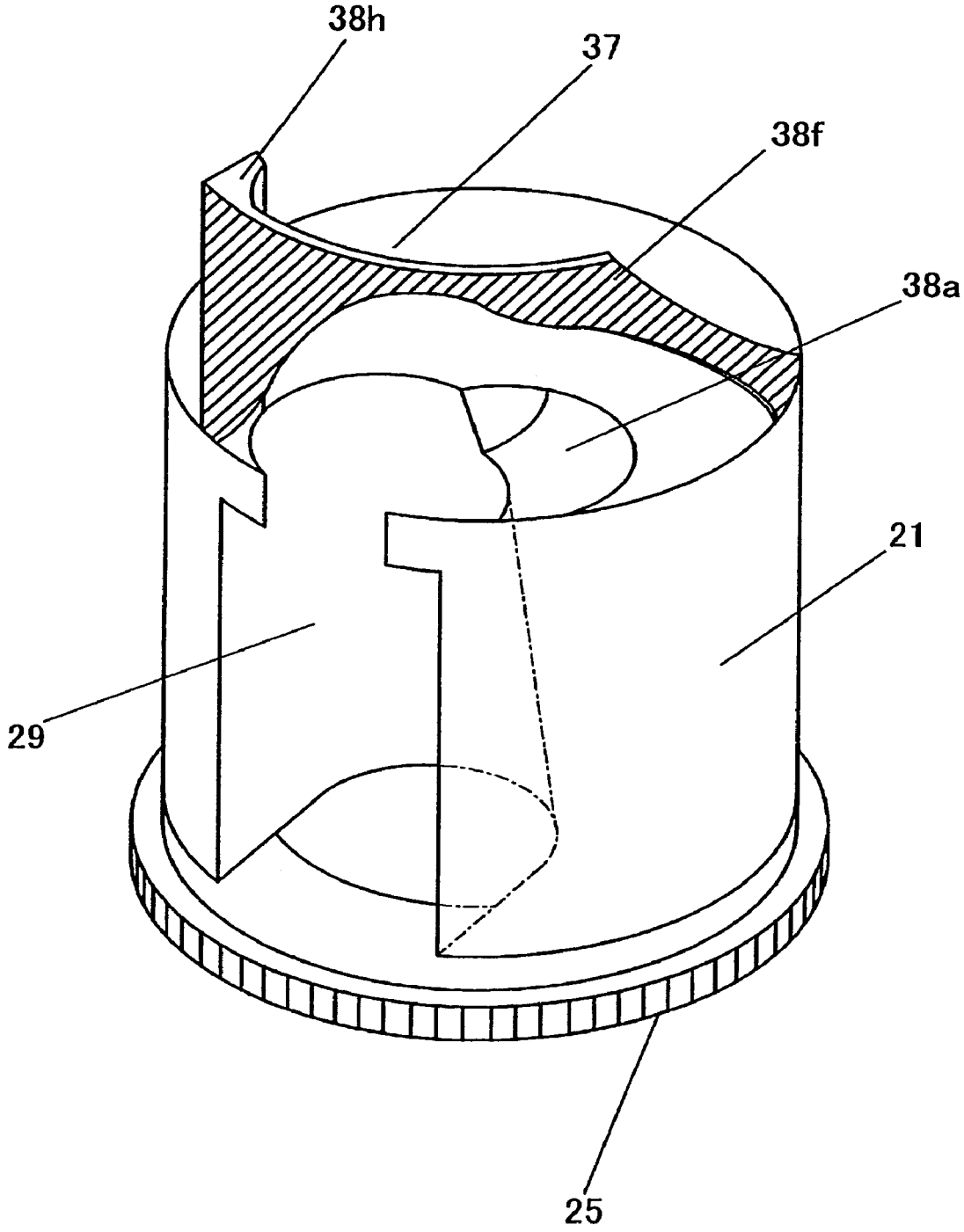
FIG. 16 is a perspective view showing a rotating body in another example.

A rotating body 21, shown in FIG. 13 or FIG. 16, is suitable for delivery of vials.

The rotating body 21 shown in FIG. 13 is composed of a plurality of grooves formed at a constant pitch from the peripheral face along the axial direction and a step portion 38*c* continuously provided in the housing portion 29. The step portion 38*c* knocks an upright vial sideways to facilitate housing of the vial in the housing portion 29. Here, the step portion 38*c* constitutes an introduction supporting portion of the present invention.

Figure 14:
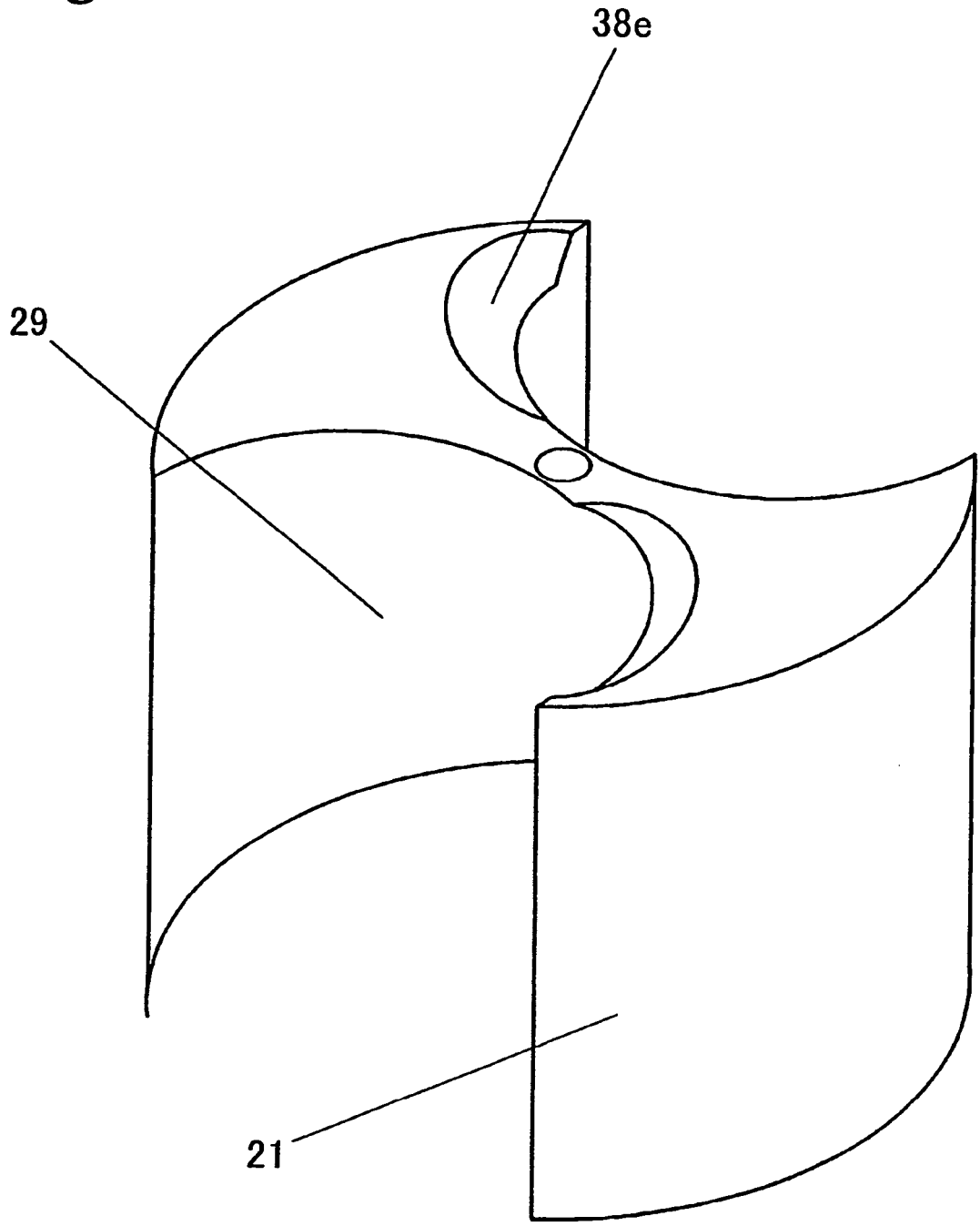
FIG. 14 is a perspective view showing a rotating body in another example.
Figure 15:
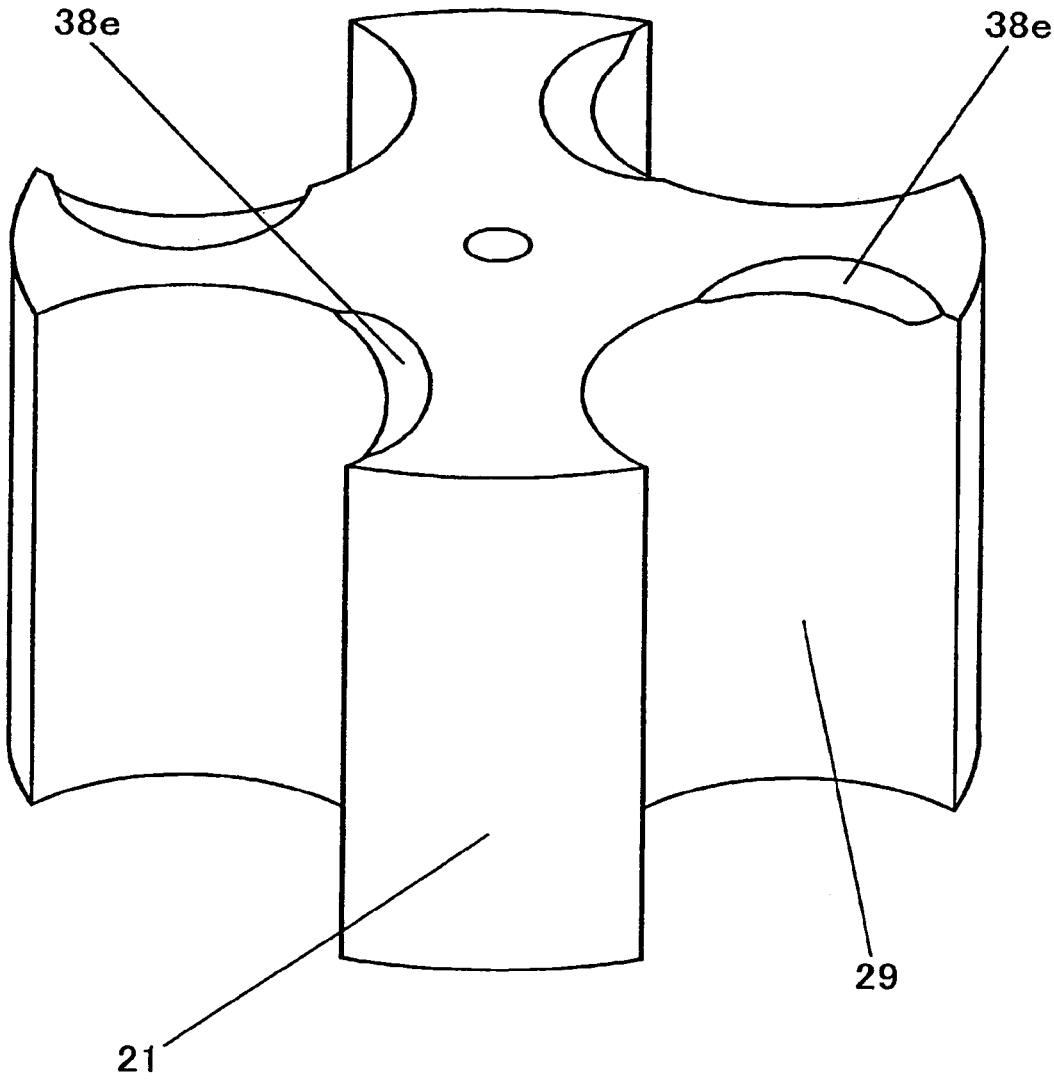
FIG. 15 is a perspective view showing a rotating body in another example.

Rotating bodies 21 shown in FIG. 14 and FIG. 15 have approximately U-shaped housing portions 29 in the position of point symmetry around a rotational axis (two portions in FIG. 14 and four portions in FIG. 15) formed closer to the vicinity of the rotational axis so as to be slightly larger than the diameter of the vial. On one end face of the rotating body 21, part of an aperture verge of the housing portion 29 is diagonally removed to form an introduction supporting portion 38*e* of the present invention. Consequently, rotation of the rotating body 21 efficiently introduces an injection drug into the housing portion 29.

A rotating body 21 shown in FIG. 16 has a housing portion 29 provided in one position that is eccentric from the center of rotation. The length of the housing portion 29 is almost equal to the length of an injection drug for preventing delivery of two injection drugs at the same time. Also, the housing portion 29 is inclined from the periphery side on one end face of the rotating body 21 toward the center side on the other end face. Part of an aperture verge on one end side of the housing portion 29 is diagonally removed to form a guide recess portion 38*a*. Around the aperture portion on one end side of the housing portion 29, there is formed a standing wall 37. The standing wall 37 is provided with a scooper portion 38*f* thin enough to easily scoop up injection drugs by rotation of the rotating body 21, and a guide portion 38*h* for guiding the injection drugs scooped up by the scooper portion 38*f*. The guide recess portion 38*a* and the standing wall 37 constitute the introduction supporting portion of the present invention. On the lower end periphery of the rotating body 21, there is formed a gear 25 for transmitting driving forces.

According to the rotating body 21, rotation via the gear 25 introduces the injection drugs inside the inclined space container 20 to the housing portion 29 with the scooper portion 38*f* being in a position along the bottom face of the space container 20. At the same time, the injection drug that is not fully housed in the housing portion 29 is guided by the guide portion 38*h* so as to be certainly introduced into the housing portion 29. When the rotating body 21 rotates approx. 180°, the housing portion 29 directs inclined lower side, which enables delivery of the injection drug housed in the housing portion 29.

Figure 17:
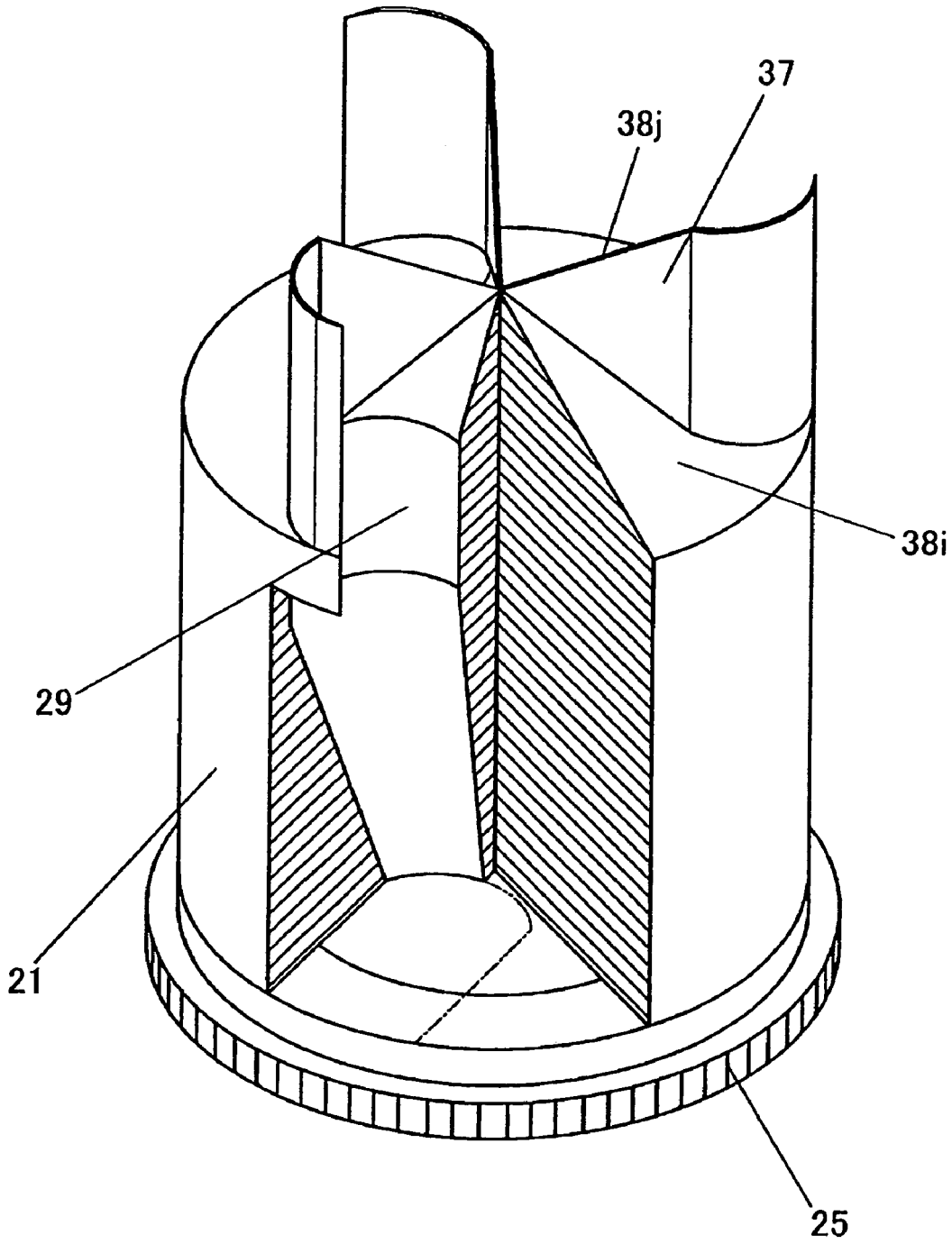
FIG. 17 is a perspective view showing a rotating body in another example.

A rotating body 21 shown in FIG. 17 is suitable for delivery of an ampoule. A housing portion 29 is formed in three points equally provided in the position eccentric from the center of rotation, and is different from the rotating body 21 shown in FIG. 16 in a point that one end face 38*i* has a conical shape.

According to the rotating body 21, the conical face 38*i* on one end prevents accumulation of the injection drugs. As a result, an injection drug is introduced into the housing portion 29 without being disturbed by pressure from the upper injection drugs. It is noted that a flat portion 38*j* of the standing wall 37 extending toward the center of rotation prevents a plurality of injection drugs from being scooped up.

Figure 31A:
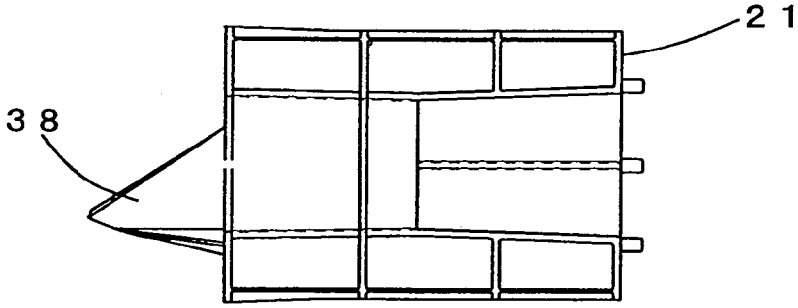
FIG. 31A is a front view showing a rotating body in another example.
Figure 31B:
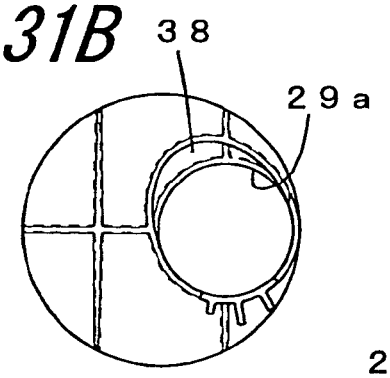
FIG. 31B is a left side view of FIG. 31A.
Figure 31C:
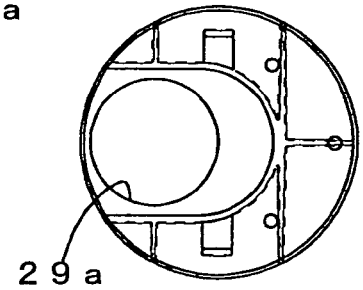
FIG. 31C is a right side view of FIG. 31A.

A rotating body 21 shown in FIG. 31 is suitable for delivery of a large-size ampoule. More particularly, the rotating body 21 shown in FIG. 31 has an inclined hole 29*a* provided so as to be slightly inclined from an eccentric position on one end face toward the central side and opened not only toward the other side face but also toward a lateral side on the other end side. On one end face of the rotating body 21, an introduction auxiliary member 38 gradually narrowed toward the top end is formed so as to be continued to the inclined hole 29*a*. The introduction auxiliary member 38 has a function of facilitating introduction of an ampoule into the inclined hole 29*a*. Also, the rotating body 21 is a single component formed by injection molding, in which quantity of resin consumed is restrained by a grid-like rib on the peripheral side. This structure enables delivery of large-size ampoules without changing the shape of the mounting part of the space container 20.

Figure 32:
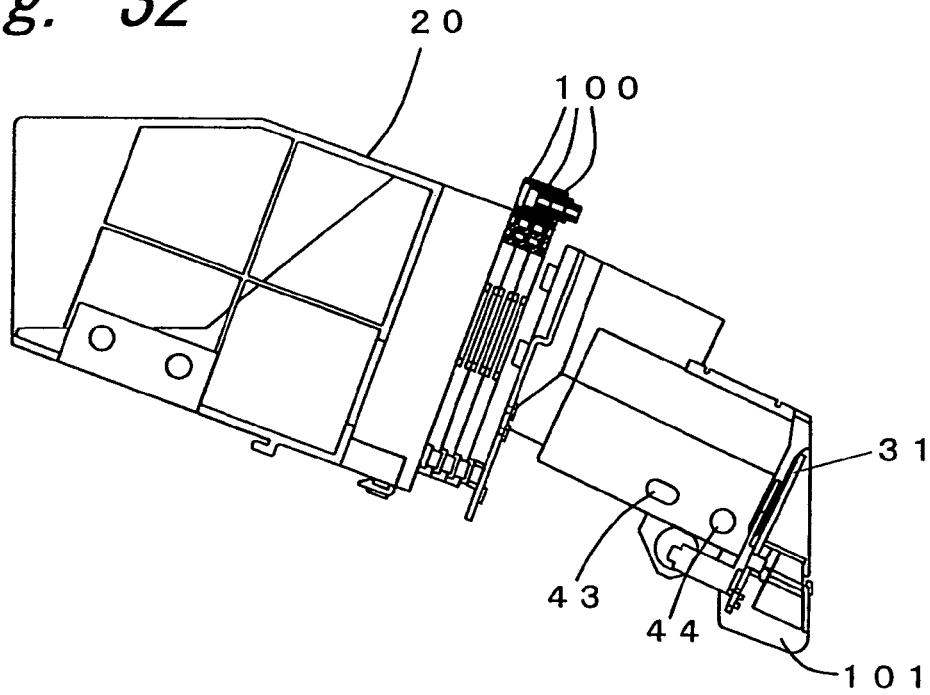
FIG. 32 is a front view showing an example of providing an adjusting plate and a liquid recovery container on the space container.
Figure 33A:
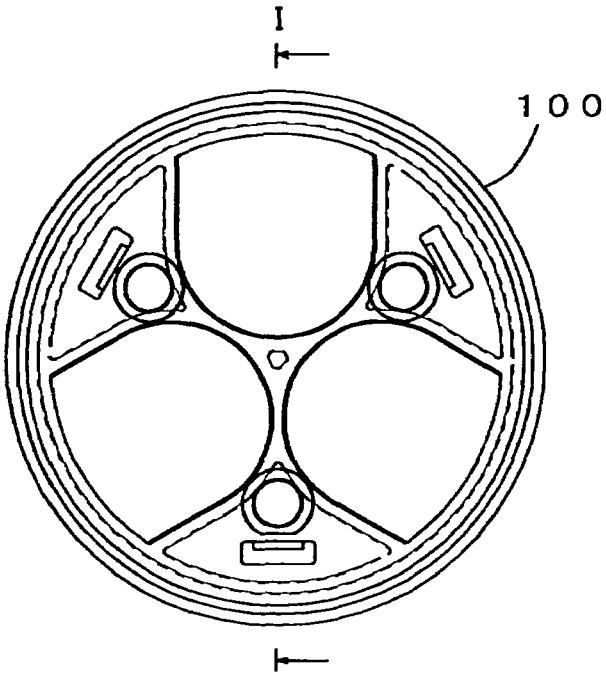
FIG. 33A is a plan view showing the adjusting plate of FIG. 32 in one example.
Figure 33B:
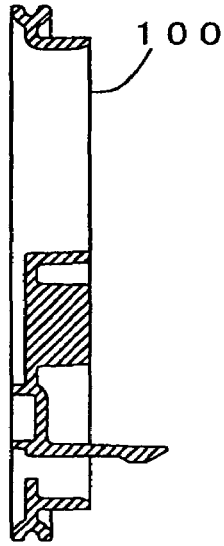
FIG. 33B is a cross sectional view taken along lines I-I of FIG. 33A.
Figure 34A:
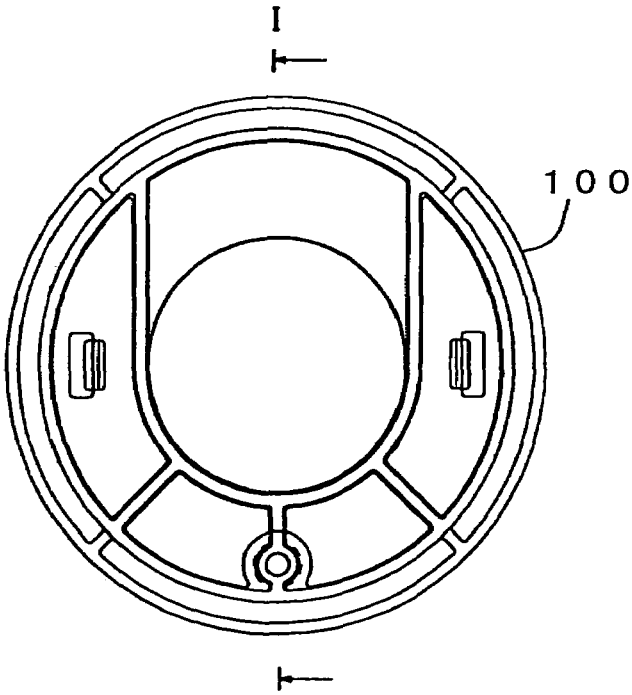
FIG. 34A is a plan view showing the adjusting plate of FIG. 32 in another example.
Figure 34B:
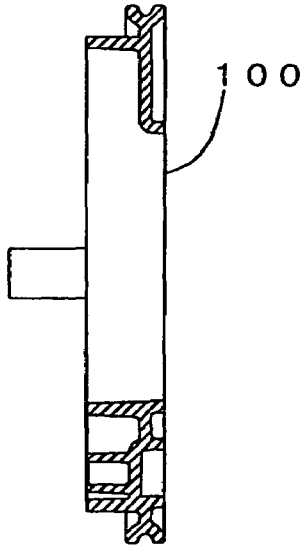
FIG. 34B is a cross sectional view taken along lines I-I of FIG. 34A.

Although in the above embodiment, the rotating body 21 is formed to have a length corresponding to the size of injection drugs, an appropriate number of adjusting plates 100 can be provided to conform to the difference of the length of the rotating body 21 on the space container 20 fulfills common use as shown in FIG. 32. In this case, the adjusting plate 100 may be provided with, for example, a penetrating hole 104 formed in response to the number and the position of the inclined hole 29*a* formed on the rotating body 21 as shown in FIGS. 33A, B, and FIGS. 34A, B.

Also in the above embodiment, there was shown the structure in which an injection drug contained in a generally-shaped container such as ampoules is delivered. However, a plurality of connected plastic ampoules in a special shape may be delivered one by one by use of an injection drug storing container 9 shown in FIG. 18.

Figure 18A:
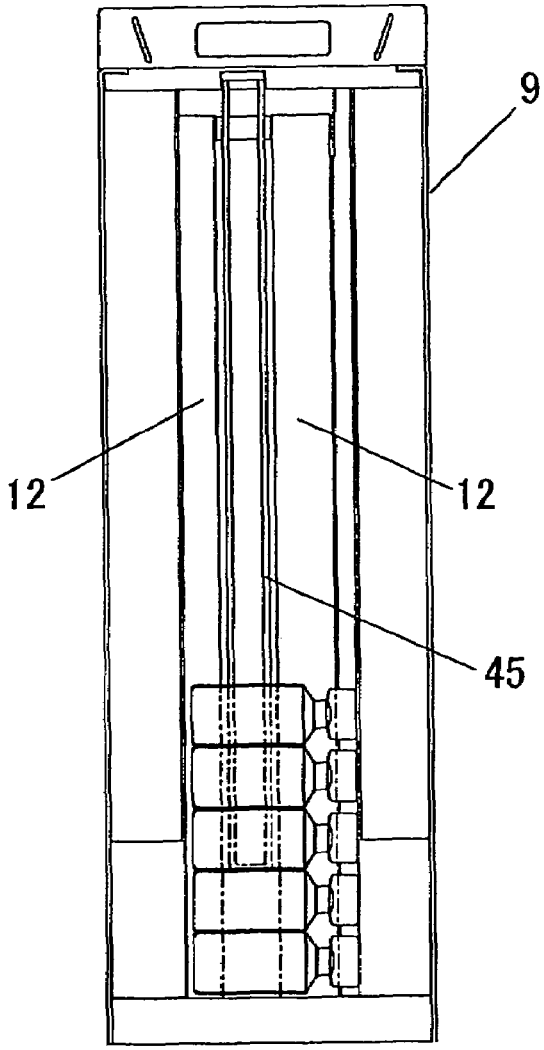
FIG. 18A is a plan view showing an injection drug storing container for plastic ampoules.
Figure 18B:
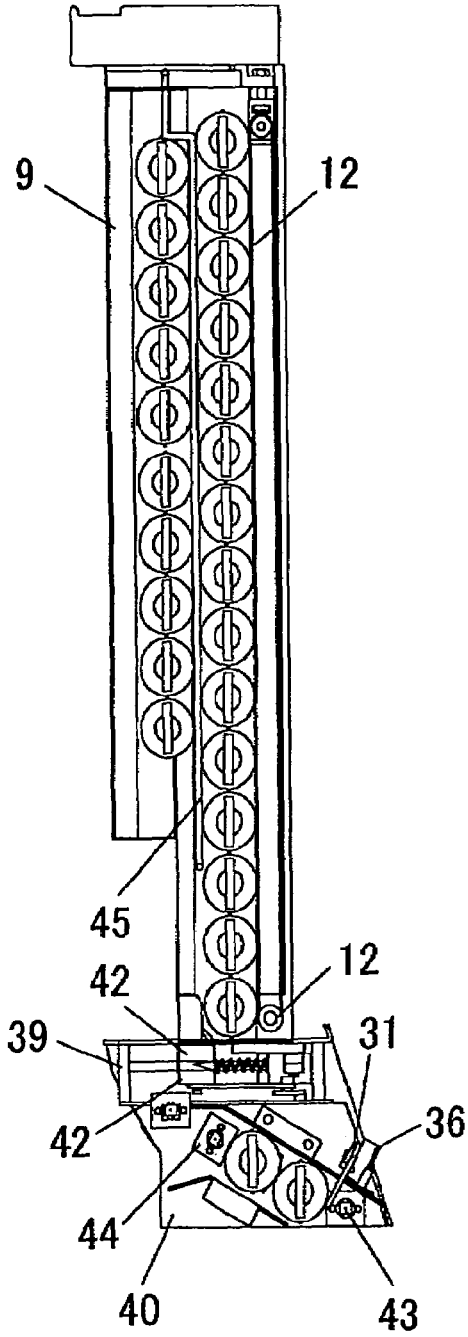
FIG. 18B is a cross sectional front view of FIG. 18A.
Figure 18C:
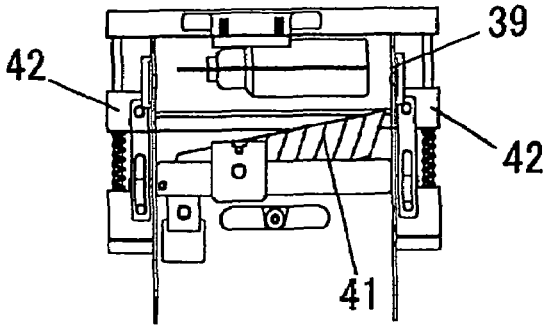
FIG. 18C is a cross sectional view showing a cutting portion of FIG. 18A.

The injection drug storing container 9 shown in FIG. 18 is provided with a transportation conveyer belt 12 on the bottom face, and a cutting portion 39 and a reserving portion 40 on one end portion. The cutting portion 39 is composed of a cutter 41 and a positioning member 42 provided on the both sides of the cutter 41 as shown in FIG. 18C. The cutting portion 39 is raised and lowered by an unshown cam. In a cutting operation, the positioning member 42 positions plastic ampoules and the cutter 41 cuts an attachment portion thereof. The reserving portion 40 has a shutter 31 that is opened and closed by a solenoid 88 on the lower side. The plastic ampoules delivered by opening and closing of the shutter 31 are detected by sensors 43 and 44, and the number of passing ampoules is counted. In this case, the space container 20 is preferably made from black resin such as ABS for increasing the sensitivity of each of the sensors 43 and 44.

Inside the injection drug storing container 9, there is provided a partition member 45 so as to enable ascending and descending, which makes it possible to dispose the plastic ampoules in the upper and lower two rows. The partition member 45 descends after the plastic ampoules in the lower row are delivered, and mounts the plastic ampoules in the upper row on the conveyer belt 12 to enable delivery.

Figure 19A:
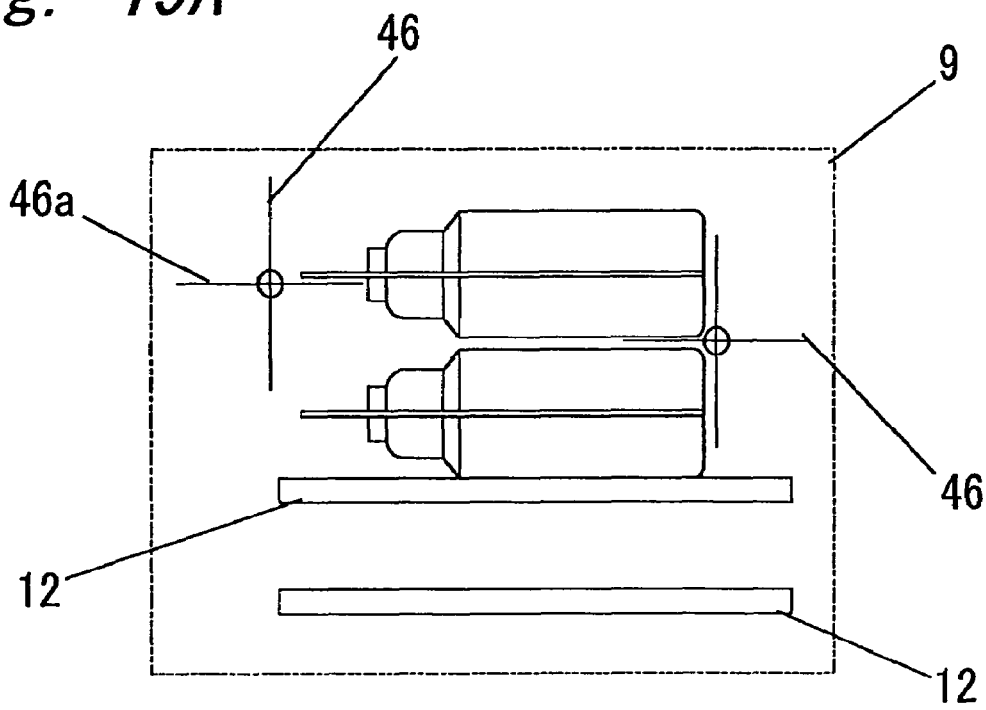
FIG. 19A is a schematic view showing a partition member used in the injection drug storing container for plastic ampoules in another example.
Figure 19B:
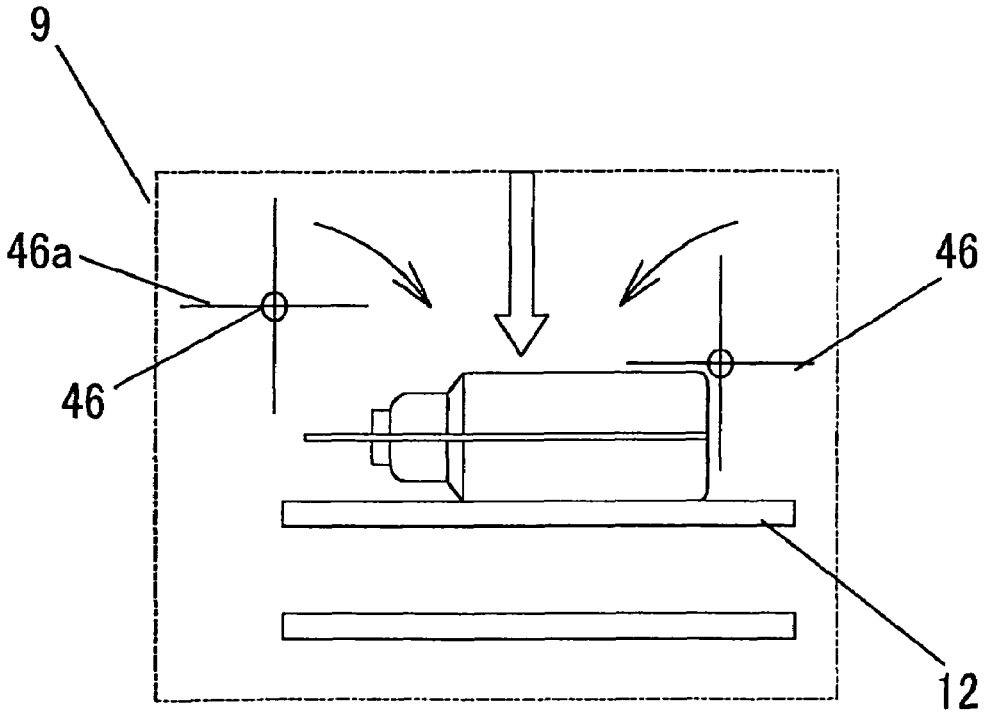
FIG. 19B is a schematic view showing an operating state from FIG. 19A.

Instead of the partition member 45, there may be used, for example, a partition member 46 structured such that a partition vane 46*a* is provided in four equally divided parts on a rotational axis as shown in FIG. 19A and FIG. 19B. The partition member 46 is provided on the both end portions of the plastic ampoules, and the partition vanes 46*a* are positioned between the plastic ampoules disposed in the upper row and the lower row. When all the plastic ampoules in the lower row are delivered, the rotational axis is rotated 90° to move the plastic ampoules in the upper row to the lower row. Here, a next partition vane 46*a* is positioned on the upper side of both ends of the plastic ampoules moved to the lower row, which enables disposal of the next plastic ampoules in the upper row.

Figure 20A:
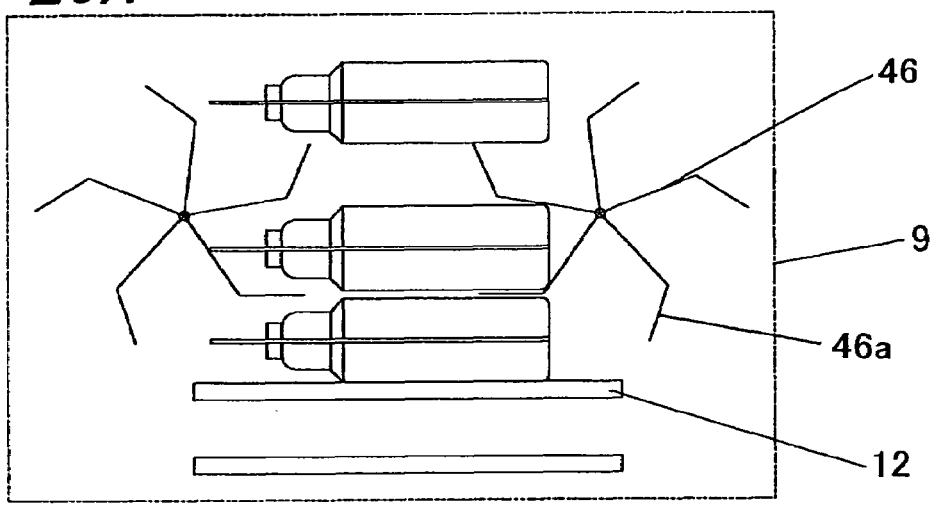
FIG. 20A is a schematic view showing a partition member used in the injection drug storing container for plastic ampoules in another example.
Figure 20B:
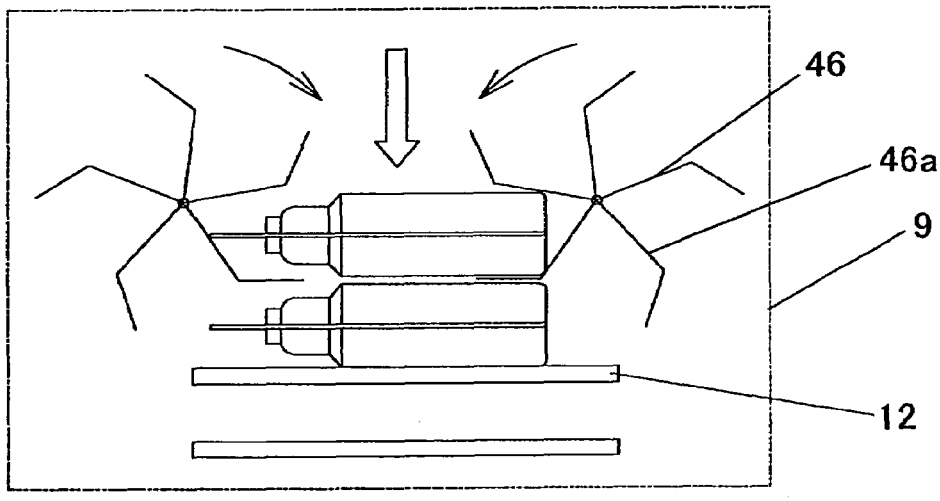
FIG. 20B is a schematic view showing an operating state from FIG. 20A.
Figure 20C:
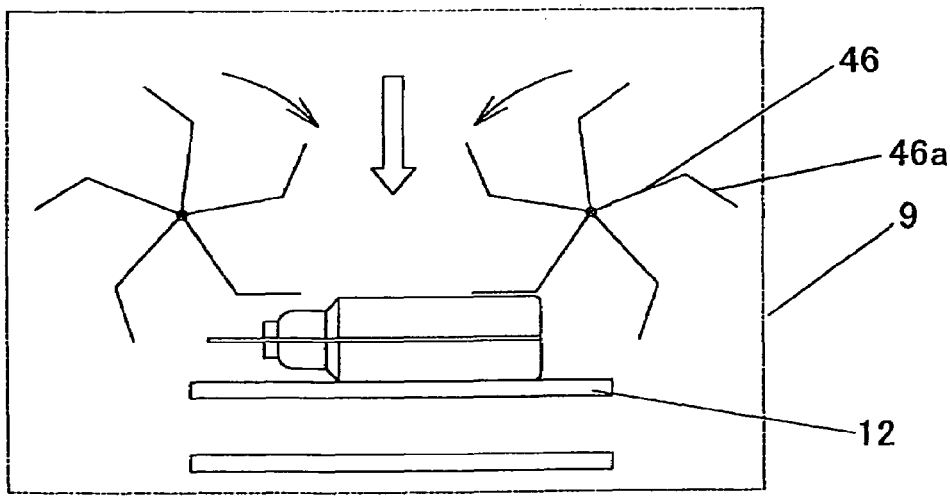
FIG. 20C is a schematic view showing an operating state from FIG. 20B.

Also, if the partition member 46 is structured such that a partition vane 46*a* curved in a middle portion is provided in five equally divided parts as shown in FIG. 20, disposal of plastic ampoules in three row is available.

Also, the space container 20 may be provided with a liquid recovery container 101 for recovering leaked liquid on the downstream side of the shutter 31 as shown in FIG. 32. More specifically, since ampoules are delivered by rotation of the rotating body 21 via the inclined hole 29*a* one by one, they may be subject to impact forces due to falling and the like, resulting in breakage and leakage of content fluid. Accordingly, in order to prevent wide range contamination by the content fluid, the fluid is recovered by the liquid recovery container 101. Although the ampoules are rarely broken upstream of the rotating body 21 of the space container 20, there may be provided a hose and the like extending from the upstream bottom face to the side of the liquid recovery container 101 in case of an emergency.

What is claimed:

1. An injection drug feeding device for automatically feeding an appropriate injection drug based on injection drug prescription data, the injection drug feeding device comprising:

a casing having cold reserving space divided by a heat insulator;

a support casing provided inside the casing for supporting transportation means that transports each injection drug housed by kind;

a plurality of injection drug collection buckets, at least one of the drug collection buckets positioned in the casing; and a transportation line for moving the plurality of injection drug collection buckets, wherein the support casing has a slidable input door provided for enabling transfer of the injection drugs to at least one of the injection drug collection buckets.

2. The injection drug feeding device as claimed in claim 1, further comprising a cooling device mounted on a casing frame of the casing.

3. The injection drug feeding device as claimed in claim 1, wherein the casing further comprises a front door formed of a heat insulating material.

4. The injection drug feeding device as claimed in claim 1, wherein the casing further comprises an identification window for enabling identification of an injection drug, and indication means for indicating the presence of an injection drug.

5. The injection drug feeding device as claimed in claim 1, wherein the door includes a confirmation window for enabling confirmation of an operating state of the transportation means.

6. The injection drug feeding device as claimed in claim 1, wherein the input door includes a gutter for recovering dew condensation water, wherein the gutter is provided on a peripheral portion of the input door.

7. The injection drug feeding device as claimed in claim 6, wherein the gutter is adapted to recover dew condensation water is a state in which the input door is opened by a predetermined amount and is temporarily stopped.

8. The injection drug feeding device as claimed in claim 1, wherein the slidable input door is provided in a lower portion of the support casing.

* * * * *